US011724375B2

(12) United States Patent
Ootsuka

(10) Patent No.: US 11,724,375 B2
(45) Date of Patent: Aug. 15, 2023

(54) DRIVING TOOL WITH SWITCHING MECHANISM

(71) Applicant: KOKI HOLDINGS CO., LTD., Tokyo (JP)

(72) Inventor: Kazuhiro Ootsuka, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 217 days.

(21) Appl. No.: 17/257,751

(22) PCT Filed: May 31, 2019

(86) PCT No.: PCT/JP2019/021779
§ 371 (c)(1),
(2) Date: Jan. 4, 2021

(87) PCT Pub. No.: WO2020/008768
PCT Pub. Date: Jan. 9, 2020

(65) Prior Publication Data

US 2022/0126431 A1 Apr. 28, 2022

(30) Foreign Application Priority Data

Jul. 6, 2018 (JP) ..... 2018-129432

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC ..... B25C 1/047
See application file for complete search history.

(56) References Cited

U.S. PATENT DOCUMENTS 5,098,004 A * 3/1992 Kerrigan ..... B25C 5/15 173/121
2004/0155743 A1* 8/2004 Sako ..... B25C 1/06 335/220

(Continued)

FOREIGN PATENT DOCUMENTS

JP 09-014433 A 1/1997
JP 2007-222989 A 9/2007

(Continued)

OTHER PUBLICATIONS

International Search Report issued in corresponding International Patent Application No. PCT/JP2019/021779, dated Aug. 6, 2019, with English translation.

*Primary Examiner* — Robert F Long
*Assistant Examiner* — Xavier A Madison
(74) *Attorney, Agent, or Firm* — McDermott Will & Emery LLP

(57) ABSTRACT

A driving tool having a striking unit and a driver unit includes a solenoid configured to switch between a first state and a second state by being actuated by the supply and stop of the electric power, wherein the driver unit has a first drive state in which the striking unit can be actuated and a second drive state in which the actuation of the striking unit is blocked, wherein the first state enables the driver unit to switch from the second drive state to the first drive state and the second state blocks the driver unit from switching from the second drive state to the first drive state, and wherein an actuation direction of the solenoid and the moving direction of the nail are arranged so as to intersect each other.

8 Claims, 15 Drawing Sheets

(56) References Cited

U.S. PATENT DOCUMENTS

| | | | | |
|---|---|---|---|---|
| 2008/0314952 | A1 | 12/2008 | Tamura et al. | |
| 2014/0110451 | A1* | 4/2014 | Largo | B25C 1/08 227/8 |
| 2018/0126528 | A1* | 5/2018 | Pomeroy | B25C 1/008 |
| 2019/0375083 | A1* | 12/2019 | Ishikawa | B25C 1/06 |

FOREIGN PATENT DOCUMENTS

| | | | |
|---|---|---|---|
| JP | 2010-184337 | A | 8/2010 |
| JP | 2018-043294 | A | 3/2018 |

* cited by examiner

DRIVING TOOL WITH SWITCHING MECHANISM

CROSS REFERENCE TO RELATED APPLICATIONS

This application is the U.S. National Phase under 35 US.C. § 371 of International Application No. PCT/JP2019/021779, filed on May 31, 2019, which claims the benefit of Japanese Application No. 2018-129432, filed on Jul. 6, 2018, the entire contents of each are hereby incorporated by reference.

TECHNICAL FIELD

The present invention relates to a driving tool including a striking unit provided to be actuatable and a driver unit capable of actuating the striking unit.

BACKGROUND ART

A driving tool including a striking unit provided to be actuatable and a driver unit capable of actuating the striking unit is described in Patent Document 1. The driving tool described in Patent Document 1 includes a cylinder, a pressure accumulation container, a striking unit, a driver unit, a push lever as a contact member, a trigger as an operating member, a power source, a control unit, an ejection unit, a magazine, and a remaining number notification mechanism. The striking unit has a piston and a driver blade, and the piston can be actuated in the cylinder. The driver unit has a pressure chamber, an electric motor, and a wheel. The pressure chamber is formed across the inside of the pressure accumulation container and the cylinder. Fasteners in the magazine are supplied to the ejection unit. The driver blade has a rack and the wheel has a pin. The remaining number notification mechanism has a stopper as a switching mechanism and an elastic member that prevents the actuation of the stopper. The stopper can be actuated with respect to the ejection unit.

When the push lever is pressed to a workpiece and an operation force is applied to the trigger, power from the power source is supplied to the electric motor and the electric motor is rotated. A rotational force of the electric motor is transmitted to the wheel. When the pin and the rack are engaged with each other, the striking unit is actuated in a second direction against a force of the pressure chamber. When the pin and the rack are released from each other, the striking unit is actuated in a first direction by the force of the pressure chamber and strikes the fastener. When the remaining number of the fasteners in the magazine is equal to or larger than a predetermined number, the stopper enables the actuation of the push lever. Namely, the striking unit can be actuated in the first direction. The stopper is actuated in accordance with the remaining number of fasteners in the magazine, and the stopper blocks the actuation of the push lever when the remaining number of fasteners is smaller than the predetermined number. Namely, the actuation of the striking unit in the first direction is hindered.

RELATED ART DOCUMENTS

Patent Documents

Patent Document 1: Japanese Unexamined Patent Application Publication No. 2018-43294

SUMMARY OF THE INVENTION

Problem to be Solved by the Invention

The inventor of the present invention has found the problem that, if the switching mechanism to control the actuation of the striking unit is configured so as to be actuated by the supply and stop of electric power, the state of the switching mechanism may be switched due to a factor different from the supply and stop of electric power.

An object of the present invention is to provide a driving tool capable of suppressing the switching of the state of the switching mechanism due to a factor different from the supply and stop of electric power.

Means for Solving the Problems

A driving tool according to an embodiment includes a striking unit provided to be actuatable and a driver unit capable of actuating the striking unit in a direction in which the striking unit strikes a fastener, and the driving tool comprises: an ejection unit configured to guide a moving direction of the fastener struck by the striking unit; and a switching mechanism having a first state and a second state for controlling the striking unit, actuated by power supply to switch between the first state and the second state, and configured to maintain the first state or the second state achieved by being actuated by the power supply when the power supply is stopped, wherein the driver unit has a first drive state which enables the striking unit to be actuated in the direction of striking the fastener and a second drive state which blocks the striking unit from being actuated in the direction of striking the fastener, wherein the first state enables the driver unit to switch from the second drive state to the first drive state and the second state blocks the driver unit from switching from the second drive state to the first drive state, and wherein an actuation direction of the switching mechanism and the moving direction of the fastener guided by the ejection unit are arranged so as to intersect each other.

Effects of the Invention

The driving tool according to one embodiment can suppress the switching of the state of the switching mechanism due to a factor different from the supply and stop of electric power.

DETAILED DESCRIPTION OF PREFERRED EMBODIMENTS

Driving tools according to typical embodiments of the present invention will be described with reference to the drawings.

First Embodiment

Figure 1:
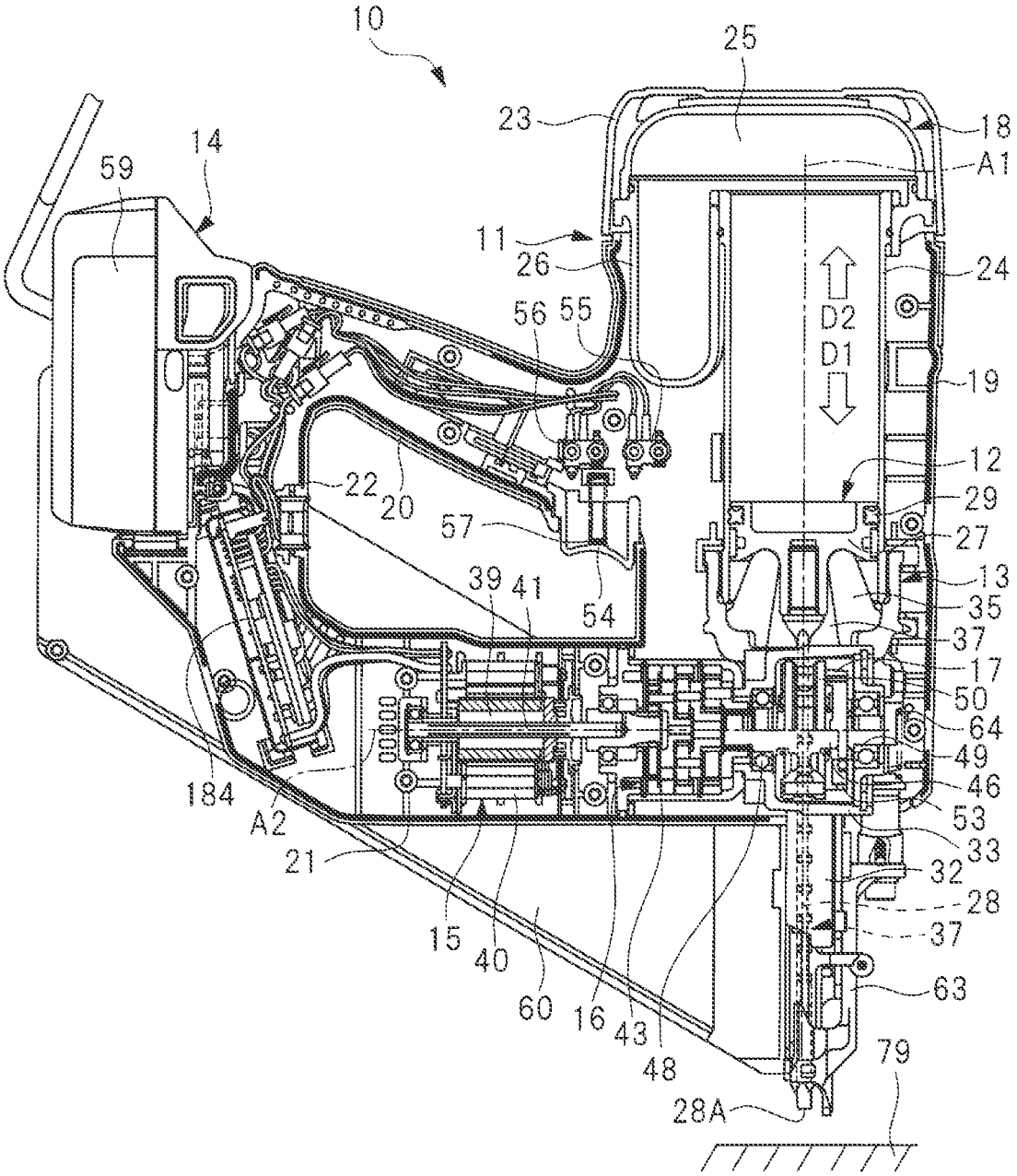
FIG. 1 is a front cross-sectional view showing an internal structure of a driving tool according to the first embodiment of the present invention.

A driving tool 10 shown in FIG. 1 includes a housing 11, a striking unit 12, a nose unit 13, a power source unit 14, an electric motor 15, a deceleration mechanism 16, a clutch 17, and a pressure accumulation container 18. The housing 11 is an outer shell element of the driving tool 10, and the housing 11 includes a cylinder case 19, a handle 20, a motor case 21, and a mounting unit 22. The cylinder case 19 has a tubular shape and the handle 20 is connected to the cylinder case 19. The motor case 21 is connected to the cylinder case 19. The mounting unit 22 is connected to the handle 20 and the motor case 21.

The power source unit 14 is detachably attached to the mounting unit 22. The electric motor 15 is arranged in the motor case 21. A head cover 23 is attached to the cylinder case 19, and the pressure accumulation container 18 is arranged across the inside of the cylinder case 19 and the inside of the head cover 23.

A cylinder 24 is housed in the cylinder case 19. The cylinder 24 is positioned with respect to the cylinder case 19 in the direction of a center line A1 and the radial direction. A pressure chamber 25 is formed across the inside of the pressure accumulation container 18 and the inside of the cylinder 24. The pressure chamber 25 is filled with compressible gas. As the compressible gas, inert gas can be used in addition to air. Examples of the inert gas include nitrogen gas and rare gas. In this disclosure, an example in which the pressure chamber 25 is filled with air will be described. The pressure accumulation container 18 is attached to an outer peripheral surface of the cylinder 24 via a holder 26.

The striking unit 12 is arranged from the inside to the outside of the housing 11. The striking unit 12 includes a piston 27 and a driver blade 28. The piston 27 can be actuated in the cylinder 24 in the direction of the center line A1. The center line A1 is the center of the cylinder 24. A sealing member 29 is attached to an outer peripheral surface of the piston 27. The sealing member 29 is in contact with an inner peripheral surface of the cylinder 24 to form a sealing surface.

The driver blade 28 is made of metal. The piston 27 and the driver blade 28 are provided as separate members, and the piston 27 and the driver blade 28 are connected to each other. The striking unit 12 can be actuated in the direction of the center line A1.

The nose unit 13 is arranged across the inside and outside of the housing 11. The nose unit 13 includes a bumper support portion 31, an ejection unit 32, and a tubular portion 33. The bumper support portion 31 has a tubular shape. A bumper 35 is arranged in the bumper support portion 31. The bumper 35 may be made of synthetic rubber or silicone rubber. The bumper 35 has an annular shape and has a guide hole 36. The guide hole 36 is provided to be centered about the center line A1. The bumper 35 is elastically deformed by receiving a load from the piston 27. Further, the bumper 35 serves as a stopper that restricts the range in which the piston 27 moves in the direction of the center line A1 when the piston 27 is actuated in the direction toward the ejection unit 32.

The ejection unit 32 is connected to the bumper support portion 31 and protrudes from the bumper support portion 31 in the direction of the center line A1. The ejection unit 32 is arranged outside the housing 11. The ejection unit 32 has an ejection path 37 shown in FIG. 2, and the ejection path 37 is a groove or a hole provided along the center line A1. The driver blade 28 can be actuated in the guide hole 36 and the ejection path 37 in the direction of the center line A1.

The electric motor 15 is arranged in the motor case 21. The electric motor 15 includes a rotor 39 and a stator 40. The stator 40 is attached to the motor case 21. The rotor 39 is attached to a rotor shaft 41. The electric motor 15 is a brushless motor, and the rotor 39 can rotate forward and backward.

A gear case 43 is provided in the cylinder case 19. The gear case 43 has a tubular shape and is arranged to be centered about a center line A2. The deceleration mechanism 16 is provided in the gear case 43. The deceleration mechanism 16 includes plural sets of planetary gear mechanisms. The center lines A1 and A2 are arranged so as to intersect each other in a plane parallel to the center lines A1 and A2, and are arranged so as to intersect at an angle of 90 degrees, for example. Although not shown, the center line A1 and the center line A2 are arranged so as to be separated from each other in a plane perpendicular to the center line A2.

An input element of the deceleration mechanism 16 is coupled to the rotor shaft 41. A rotating shaft 46 is provided in the tubular portion 33. The rotating shaft 46 is rotatably supported by bearings 48 and 49. The rotor shaft 41, the deceleration mechanism 16, and the rotating shaft 46 are arranged concentrically about the center line A2. An output element of the deceleration mechanism 16 is coupled so as to be rotated integrally with the rotating shaft 46.

Figure 3:
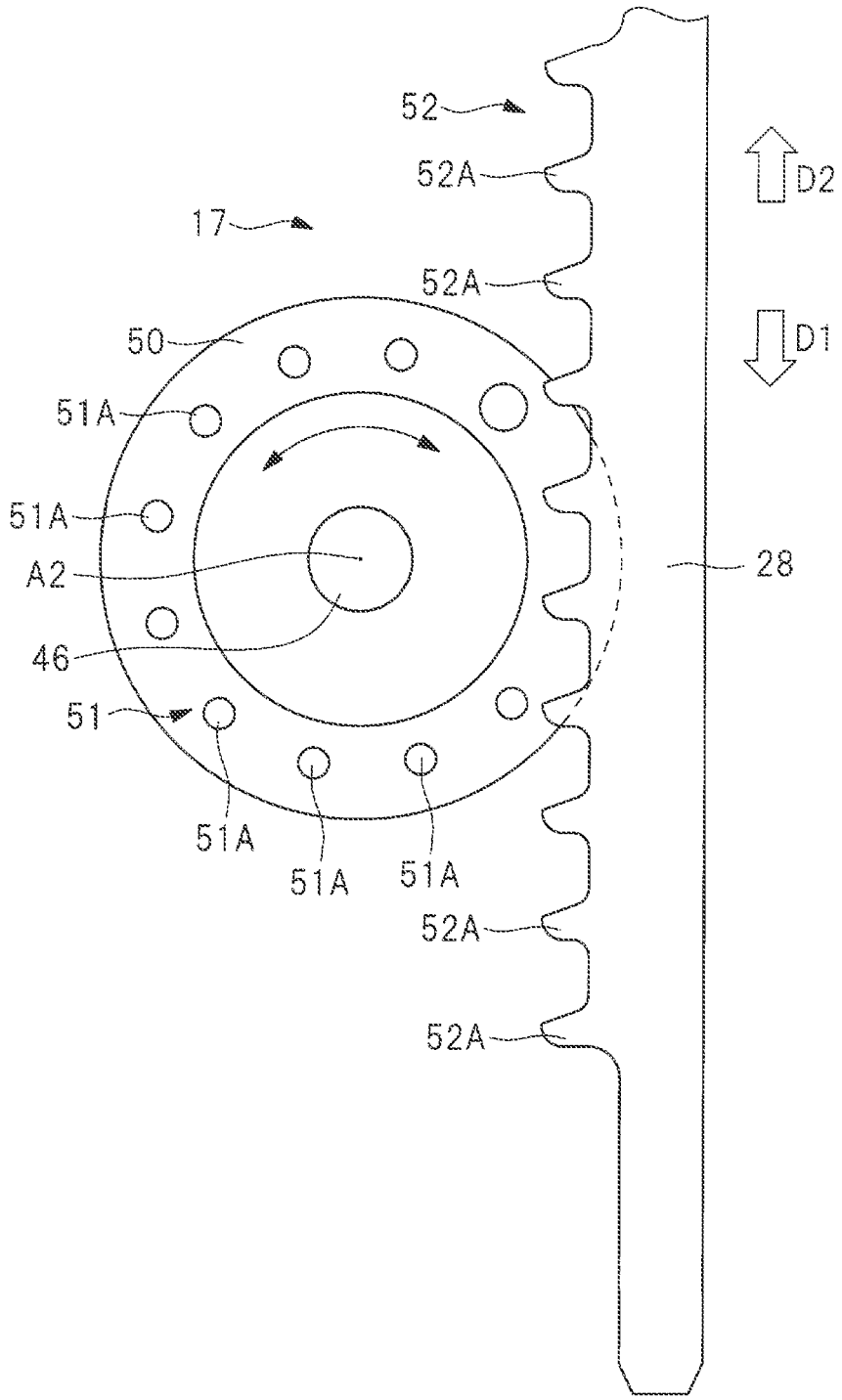
FIG. 3 is a schematic diagram of a clutch of the driving tool according to the first embodiment.

The clutch 17 is arranged in the tubular portion 33. The clutch 17 connects and disconnects a power transmission path between the rotating shaft 46 and the driver blade 28. Further, the clutch 17 has a function of converting a rotational force of the rotating shaft 46 into an actuation force of the driver blade 28. As shown in FIG. 3, the clutch 17 includes a pin wheel 50, a pinion 51, and a rack 52. The pin wheel 50 is fixed to the rotating shaft 46. The pinion 51 is provided in the pin wheel 50. The pinion 51 has a plurality of pins 51A arranged along a rotation direction of the pin wheel 50.

The rack 52 is provided on the driver blade 28. The rack 52 has a plurality of protrusions 52A arranged at intervals in an actuation direction of the driver blade 28. The pinion 51 can be engaged with and released from the rack 52. When the pinion is engaged with the rack 52 and the pin wheel 50 rotates counterclockwise in FIG. 3, the driver blade 28 is actuated in a second direction D2 by the rotational force of the pin wheel 50. When the pinion 51 is released from the rack 52, the rotational force of the pin wheel 50 is not transmitted to the driver blade 28.

The striking unit 12 shown in FIG. 1 is constantly biased in a first direction D1 by the pressure of the pressure chamber 25. The actuation of the striking unit 12 in the first direction D1 by the pressure of the pressure chamber 25 is defined as descending. The first direction D1 and the second direction D2 are parallel to the center line A1, and the second direction D2 is opposite to the first direction D1. The striking unit 12 can be actuated in the second direction D2 against the pressure of the pressure chamber 25. The actuation of the striking unit 12 in the second direction D2 in FIG. 1 is defined as ascending.

A rotation preventive mechanism 53 is provided. The rotation preventive mechanism 53 enables the pin wheel 50 to rotate counterclockwise in FIG. 3 by the rotational force of the electric motor 15 rotating forward, and enables the pin wheel 50 to rotate clockwise by the rotational force of the electric motor rotating backward. The rotation preventive mechanism 53 blocks the clockwise rotation of the pin wheel 50 when the force of the driver blade 28 in the first direction D1 is transmitted to the pin wheel 50.

Figure 2:
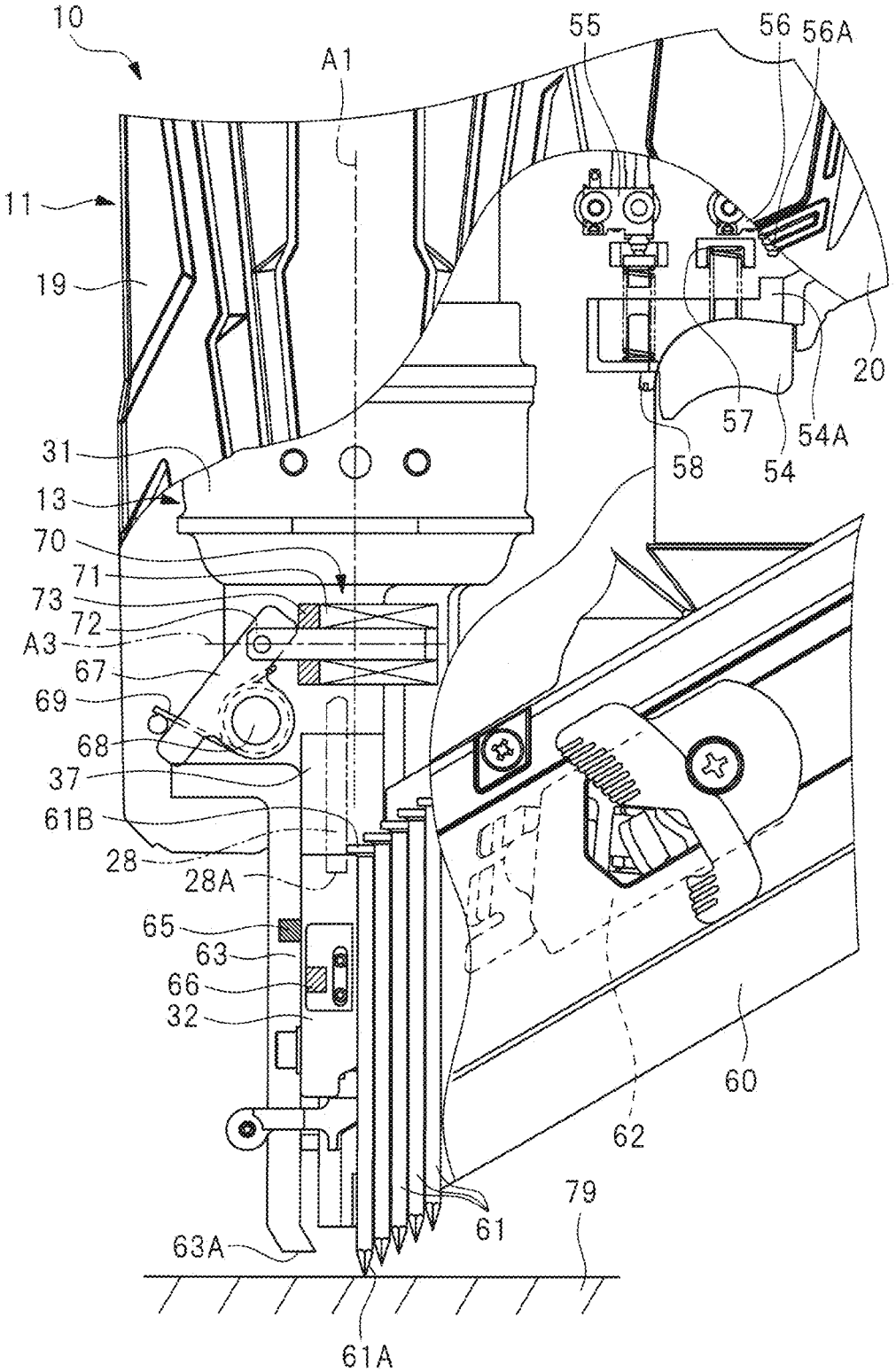
FIG. 2 is a partial rear view of the driving tool according to the first embodiment showing a state where a trigger is stopped at an initial position.

As shown in FIG. 1 and FIG. 2, the trigger 54, a first trigger switch 55, and a second trigger switch 56 are provided in the housing 11, more particularly in the handle 20 and the cylinder case 19. The second trigger switch 56 has a contact 56A. The trigger 54 can be actuated with respect to the handle 20 in parallel to the center line A1. The trigger 54 is biased by an elastic member 57, and the trigger 54 comes into contact with the stopper 58 to be stopped at the initial position. The trigger 54 has a convex portion 54A. The elastic member 57 is, for example, a metal spring.

When a worker applies an operation force to the trigger 54, the trigger 54 is actuated from the initial position against the force of the elastic member 57 and is separated from the stopper 58. When the worker releases the operation force applied to the trigger 54, the trigger 54 is pressed to the stopper 58 by the force of the elastic member 57 and is stopped at the initial position.

The first trigger switch 55 and the second trigger switch are turned on and off separately in accordance with the position of the trigger 54 in the actuation direction. When the trigger 54 is at the initial position, both the first trigger switch 55 and the second trigger switch 56 are turned off. When the trigger 54 is at a first position actuated by a predetermined amount from the initial position, the first trigger switch 55 is turned on and the second trigger switch 56 is turned off. When the trigger 54 is at a second position actuated by another predetermined amount from the initial position, both the first trigger switch 55 and the second trigger switch 56 are turned on. The amount by which the trigger 54 is actuated from the initial position to the second position is larger than the amount by which the trigger 54 is actuated from the initial position to the first position.

The power source unit 14 includes a storage case 59 and a plurality of battery cells stored in the storage case 59. The battery cell may be either a secondary battery or a primary battery. As the battery cell, a known battery cell such as a lithium ion battery, a nickel hydrogen battery, a lithium ion polymer battery, or a nickel cadmium battery can be used as appropriate.

Further, as shown in FIG. 2, a magazine 60 is attached to the ejection unit 32. The magazine 60 stores nails 61. The magazine 60 can store a plurality of nails 61 arranged in a row. The nail 61 may have a head portion or no head portion. The magazine 60 includes a feeder 62, and the feeder 62 feeds the nails 61 in the magazine 60 to the ejection path 37.

A push lever 63 is attached to the ejection unit 32. The push lever 63 can be actuated with respect to the ejection unit 32 within a predetermined range in the direction of the center line A1. As shown in FIG. 1, an elastic member 64 for biasing the push lever 63 in the direction of the center line A1 is provided. The elastic member 64 biases the push lever 63 in the direction toward the housing 11 in the direction of the center line A1. The elastic member 64 is, for example, a metal tension spring. The push lever 63 is made of, for example, synthetic resin, and a permanent magnet 65 is attached to the push lever 63.

Further, a magnetic sensor 66 is provided in the ejection unit 32. The magnetic sensor 66 is turned on and off by detecting the strength of the magnetic field of the permanent magnet 65. Namely, the magnetic sensor 66 detects the position of the push lever 63 in the direction of the center line A1.

An arm 67 is attached to the ejection unit 32. The arm 67 is made of, for example, metal or synthetic resin, and the arm 67 can be actuated about a support shaft 68. A biasing member 69 is provided in the ejection unit 32. The biasing member 69 biases the arm 67 counterclockwise in FIG. 2. The biasing member 69 is, for example, a torsion coil spring.

A solenoid 70 is provided in the ejection unit 32. The solenoid 70 is a keep solenoid having a coil 71, a plunger 72, and a permanent magnet 73. The plunger 72 is made of a magnetic material, for example, iron, and the plunger 72 can be actuated in the direction of a center line A3. The center line A2 and the center line A3 are arranged in parallel. The center line A1 and the center line A3 are arranged so as to intersect each other in a plane parallel to the center line A1, and are arranged so as to intersect at an angle of 90 degrees, for example. Although not shown, the center line A1 and the center line A3 are arranged so as to be separated from each other in a plane perpendicular to the center line A2. Further, the plunger 72 and the arm 67 are coupled to each other.

Figure 4:
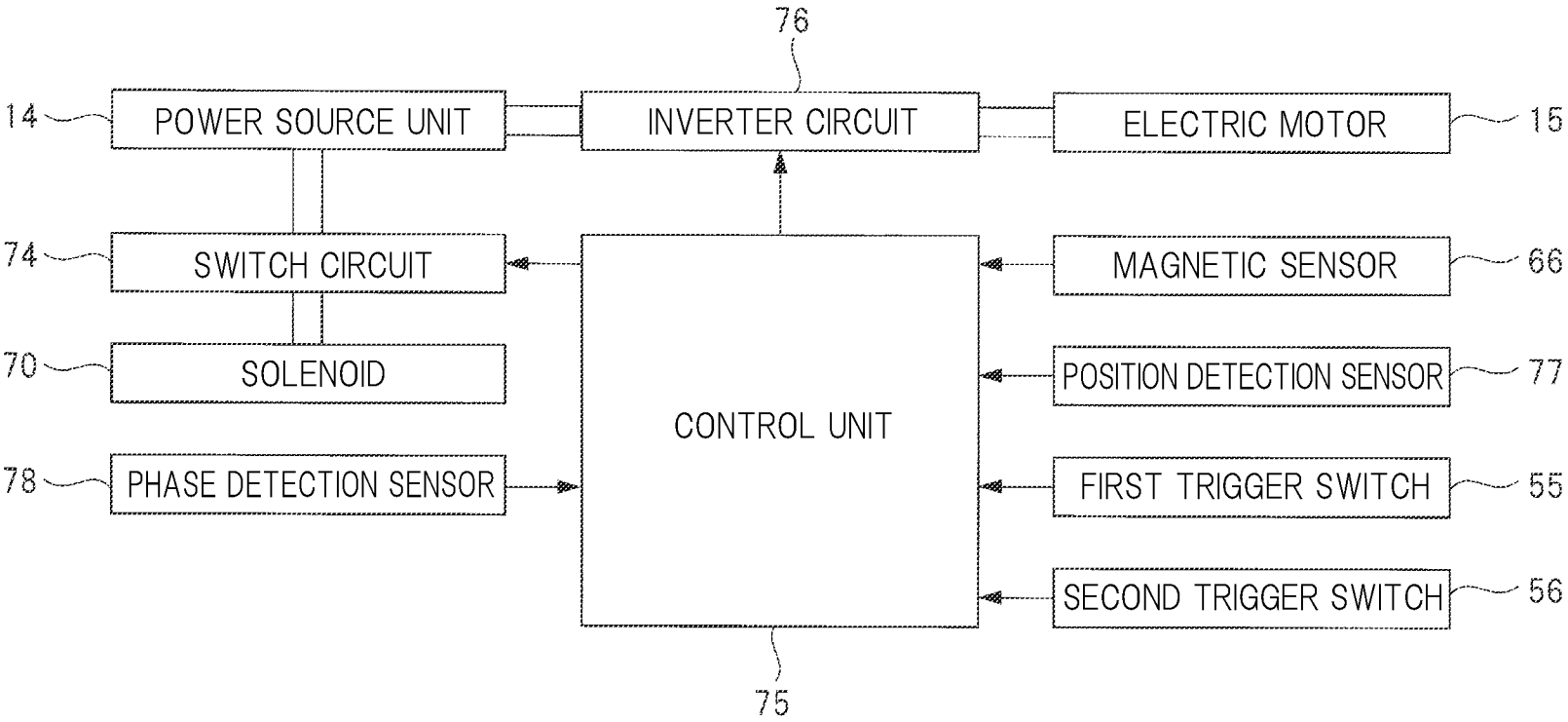
FIG. 4 is a block diagram showing a control system in the driving tool according to the first embodiment.

A switch circuit 74 shown in FIG. 4 is provided between the solenoid 70 and the power source unit 14. The switch circuit 74 can be turned on and off. The switch circuit 74 is operated so as to supply the current to the solenoid 70 or stop the current supply to the solenoid 70. When the current supply to the solenoid 70 is stopped, the plunger 72 is stopped by the attractive force of the permanent magnet 73. When a current is supplied to the solenoid 70, the plunger 72 is actuated in the direction of the center line A3 against the attractive force of the permanent magnet 73.

The switch circuit 74 can switch the direction of the current supplied from the power source unit 14 to the solenoid 70. When the direction of the current supplied to the solenoid 70 is switched, the direction in which the plunger 72 is actuated in the direction of the center line A3 is switched. When the plunger 72 is actuated in the direction away from the trigger 54 in the direction of the center line A3 in FIG. 2, the arm 67 is actuated counterclockwise. When the arm 67 is actuated counterclockwise, the actuation force of the arm 67 is transmitted to the push lever 63. The push lever 63 is actuated against the force of the elastic member 64 in the direction away from the housing 11 in the direction of the center line A1.

When the plunger 72 is actuated in the direction toward the trigger 54 in the direction of the center line A3, the arm 67 is actuated clockwise in FIG. 2. Further, the push lever 63 is actuated by the force of the elastic member 64 in the direction toward the housing 11 in the direction of the center line A1.

As shown in FIG. 1, a substrate 184 is provided in the mounting unit 22. A control unit 75 shown in FIG. 4 is provided on the substrate 184. The control unit 75 is a microcomputer having an input/output interface, an arithmetic processing unit, and a storage unit. Further, an inverter circuit 76 electrically connected to the power source unit 14 and the electric motor 15 is provided. The inverter circuit 76 connects and disconnects the stator 40 of the electric motor 15 and the power source unit 14. The inverter circuit 76 includes a plurality of switching elements, and the control unit 75 turns on and off the plurality of switching elements independently.

Also, a position detection sensor 77 and a phase sensor 78 are provided in the housing 11. The position detection sensor 77 detects the position of the pin wheel 50 in the rotation direction and outputs a signal. The phase sensor 78 detects the phase of the rotor 39 in the rotation direction.

Signals output from the first trigger switch 55, the second trigger switch 56, the position detection sensor 77, and the phase sensor 78 are input to the control unit 75, respectively. The control unit 75 processes the input signals to control the inverter circuit 76 and the switch circuit 74. In this manner, the control unit 75 controls the stop, rotation, and rotation direction of the electric motor 15, and also controls the stop and actuation of the plunger 72 of the solenoid 70 and the actuation direction of the plunger 72.

Next, an example of using the driving tool 10 will be described with reference to FIG. 2. Here, an example of fixing a metal fitting to a workpiece 79 will be described. The metal fitting has a mounting hole, and when a tip 61A of the nail 61 is inserted into the mounting hole of the metal fitting and the nail 61 is struck, the nail 61 is driven into the workpiece 79 and the metal fitting is fixed to the workpiece 79. The metal fitting is not shown for convenience.

FIG. 2 shows an initial state of the driving tool 10. In the initial state of the driving tool 10, the worker releases the operation force on the trigger 54 and the electric motor 15 is stopped. When the operation force on the trigger 54 is released, the trigger 54 is stopped at the initial position. Therefore, the first trigger switch 55 is off and the second trigger switch 56 is off.

When the control unit 75 detects that the first trigger switch 55 is off and the second trigger switch 56 is off, the control unit 75 controls the solenoid 70 to the initial state. When the solenoid 70 is in the initial state, the supply of the current from the power source unit 14 is stopped, and the plunger 72 is stopped at the initial position by the attractive force of the permanent magnet 73.

When the plunger 72 is stopped at the initial position, the arm 67 is stopped. The push lever 63 is biased by the force of the elastic member 64 in the direction toward the housing 11, and the push lever 63 is in contact with the arm 67 and is stopped at the initial position. When the push lever 63 is stopped at the initial position, a tip 63A of the push lever 63 is located between the tip 61A of the nail 61 and the housing 11 in the direction of the center line A1. The nail 61 is a nail at a position closest to the ejection path 37 among the plurality of nails 61.

Further, when the push lever 63 is stopped at the initial position, the magnetic sensor 66 is off. When the control unit 75 detects that both the first trigger switch 55 and the second trigger switch 56 are turned off and the magnetic sensor 66 is off, the control unit 75 stops the electric motor 15.

Further, in the state where the electric motor 15 is stopped, the pinion 51 is engaged with the rack 52, and the striking unit 12 is biased in the first direction D1 by receiving the pressure of the pressure chamber 25. Therefore, the pin wheel 50 receives a clockwise rotational force in FIG. 3. The rotation preventive mechanism 53 blocks the rotation of the rotating shaft 46, and the striking unit 12 is stopped at a standby position. In this embodiment, it is assumed that the piston 27 is separated from the bumper 35 when the striking unit 12 is stopped at the standby position. When the striking unit 12 is stopped at the standby position, a tip 28A of the driver blade 28 is located between a head 61B and the tip 61A of the nail 61 in the direction of the center line A1.

The worker puts the driving tool 10 in the initial state, inserts the tip 61A of the nail 61 into the mounting hole of the metal fitting, and brings the tip 61A of the nail 61 into contact with the workpiece 79. In this state, the tip 63A of the push lever 63 is separated from the workpiece 79. Next, the worker applies an operation force to the trigger 54 to actuate the trigger 54 from the initial position to the first position. When the trigger 54 is actuated from the initial position to the first position, the first trigger switch 55 is turned on and the second trigger switch 56 is turned off.

Figure 5:
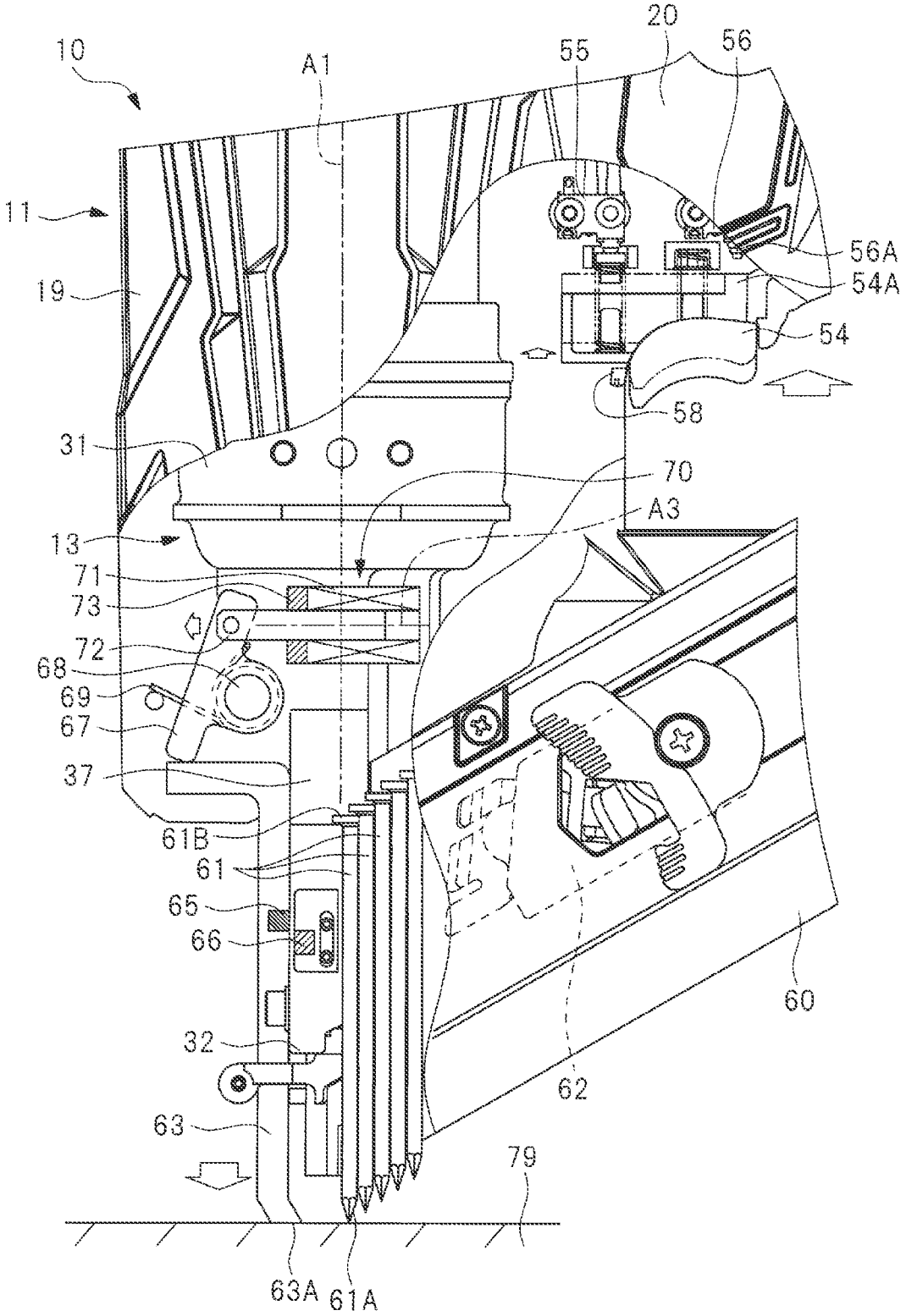
FIG. 5 is a partial rear view of the driving tool according to the first embodiment showing a state where the trigger is operated to a first position and a state where the trigger is operated to a second position.

Then, the control unit 75 controls the switch circuit 74 to supply the current to the solenoid 70 from the power source unit 14 and stop the supply of the current to the solenoid 70. The plunger 72 stopped at the initial position is actuated in the direction away from the trigger 54 in FIG. 2, and the plunger 72 is stopped at the actuated position shown in FIG. 5. When the plunger 72 is actuated from the initial position to the actuated position, the arm 67 is actuated counterclockwise in FIG. 2. The actuation force of the arm 67 is transmitted to the push lever 63, and the push lever 63 is actuated in the direction away from the housing 11 against the force of the elastic member 64. When the tip 63A of the push lever 63 comes into contact with the workpiece 79 as shown in FIG. 5, the push lever 63 is stopped at the actuated position and the arm 67 is stopped. When the push lever 63 is stopped at the actuated position, the magnetic sensor 66 is off. Further, the control unit 75 stops the electric motor 15 when the first trigger switch 55 is on and the second trigger switch 56 is off.

The worker increases the operation force applied to the trigger 54, thereby actuating the trigger 54 from the first position shown by the solid line in FIG. 5 to the second position shown by the two-dot chain line in FIG. 5. Then, the contact 56A of the second trigger switch 56 is pressed by the convex portion 54A of the trigger 54, so that the second trigger switch 56 is turned on and the first trigger switch 55 is turned on. The control unit 75 rotates the electric motor 15 forward when the magnetic sensor 66 is turned off and both the first trigger switch 55 and the second trigger switch 56 are turned on. The rotational force of the electric motor 15 is transmitted to the rotating shaft 46 through the deceleration mechanism 16, and the pin wheel 50 rotates counterclockwise in FIG. 3.

When the pin wheel 50 rotates counterclockwise in FIG. 3 and the pinion 51 is engaged with the rack 52, the striking unit 12 is actuated in the second direction D2. When the striking unit 12 is actuated in the second direction D2, the pressure of the pressure chamber 25 increases.

When the piston 27 reaches the top dead center, the pinion 51 is released from the rack 52. Then, the striking unit 12 is actuated in the first direction D1 in FIG. 1, that is, descends by the pressure of the pressure chamber 25. When the striking unit 12 descends, the driver blade 28 strikes the nail 61 in the ejection path 37, and the nail 61 is driven into the workpiece 79. The nail 61 fixes the metal fitting to the workpiece 79. The ejection path 37 guides the nail 61 such that the moving direction of the nail 61 is parallel to the center line A1. Namely, the ejection path 37 guides the nail 61 such that the moving direction of the nail 61 does not intersect the center line A1.

Further, the piston 27 collides with the bumper 35 as shown in FIG. 1 after the nail 61 is driven into the workpiece 79. The bumper 35 is elastically deformed by receiving a load in the direction of the center line A1, and the bumper 35 absorbs a part of the kinetic energy of the striking unit 12. In the state where the piston 27 is in contact with the bumper 35, the position of the striking unit 12 in the direction of the center line A1 is the bottom dead center.

Further, the control unit 75 rotates the electric motor 15, and when the pinion 51 is engaged with the rack 52, the striking unit 12 ascends from the bottom dead center to the top dead center. The control unit 75 processes the signal of the position detection sensor 77 to detect the position of the striking unit 12 in the direction of the center line A1. The control unit 75 stops the electric motor 15 when the striking unit 12 reaches the standby position.

After fixing the metal fitting to the workpiece 79 with the nail 61, the worker releases the operation force on the trigger 54. Then, the trigger 54 is actuated from the second position and returns to the initial position, and the trigger 54 is stopped at the initial position. When the trigger 54 is stopped at the initial position, both the first trigger switch 55 and the second trigger switch 56 are turned off. When the control unit 75 detects that both the first trigger switch 55 and the second trigger switch 56 are turned off, the control unit 75 supplies a current to the solenoid 70 and stops the supply of the current to the solenoid 70.

Therefore, the plunger 72 stopped at the actuated position is actuated in the direction toward the trigger 54 in FIG. 5, and the plunger 72 is stopped at the initial position shown in FIG. 2. When the plunger 72 is actuated in the direction toward the trigger 54 and is stopped at the initial position, the arm 67 is actuated clockwise in FIG. 5 and is stopped. Further, the push lever 63 is actuated in the direction toward the housing 11 by the force of the elastic member 64, and comes into contact with the arm 67 to be stopped at the initial position shown in FIG. 2.

Next, an example in which a worker applies an operation force to the trigger 54 in a state where the tip 61A of the nail is separated from the workpiece 79 will be described with reference to FIG. 6. When the worker applies an operation force to the trigger 54 and the first trigger switch 55 is turned on, the control unit 75 supplies a current to the solenoid 70 and stops the supply of the current. Therefore, the plunger 72 is actuated in the direction away from the trigger 54, and the plunger 72 is stopped at the actuated position. The arm 67 is actuated counterclockwise and the push lever 63 separates from the housing 11.

Figure 6:
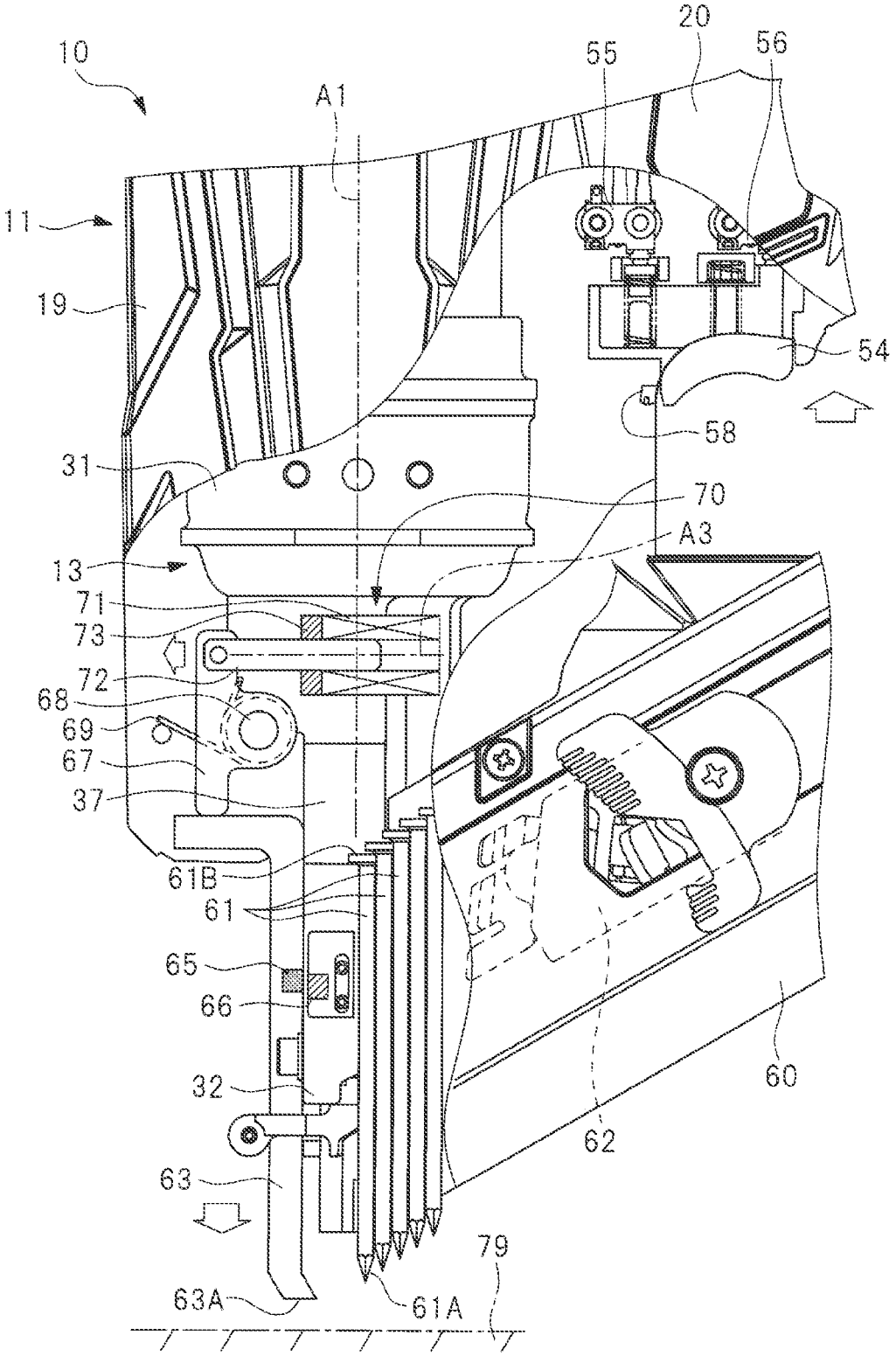
FIG. 6 is a partial rear view of the driving tool according to the first embodiment showing a state where a nail is separated from a workpiece.

Since the tip 61A of the nail 61 is separated from the workpiece 79, the push lever 63 is actuated without contacting the workpiece 79, and the push lever 63 is stopped at the maximum actuated position shown in FIG. 6. When the push lever 63 reaches the maximum actuated position, the magnetic sensor 66 is turned on. When the magnetic sensor 66 is turned on, even if the worker increases the operation force applied to the trigger 54 and the trigger 54 is actuated from the first position to the second position, so that both the first trigger switch 55 and the second trigger switch 56 are turned on, the control unit 75 stops the electric motor 15. Namely, the striking unit 12 is stopped at the standby position, and it is possible to prevent the actuation of the striking unit 12 in the state where the tip 61A of the nail 61 is separated from the workpiece 79.

As described above, when the push lever 63 is at the maximum actuated position shown in FIG. 6, the magnetic sensor 66 is turned on, and the control unit 75 stops the electric motor 15. The plunger 72 and the arm 67 block the actuation of the push lever 63 in the direction toward the housing 11. Unless the plunger 72 is actuated in the direction of the center line A3 and the plunger 72 is actuated to the initial position from the actuated position, the push lever 63 is stopped at the maximum actuated position and the magnetic sensor 66 is turned on. Therefore, even if a part of the housing 11 or the tip 61A of the nail 61 comes into contact with an object different from the workpiece 79 and the housing 11 vibrates in the direction of the center line A1, it is possible to prevent the actuation of the plunger 72 in the direction of the center line A3. Accordingly, it is possible to reliably prevent the actuation of the striking unit 12 when both the first trigger switch 55 and the second trigger switch 56 are turned on in the state where the tip 61A of the nail 61 is separated from the workpiece 79.

Second Embodiment

A driving tool according to the second embodiment will be described mainly with reference to FIGS. 7, 8, and 9. In the driving tool 10 shown in FIG. 7 and FIG. 8, the same configurations as those of the driving tool 10 shown in FIG. 1 and FIG. 2 are denoted by the same reference signs as those in FIG. 1 and FIG. 2.

A push lever 80 is attached to the ejection unit 32, and the push lever 80 can be actuated with respect to the ejection unit 32 in the direction of the center line A1. The push lever 80 has a stopper 84. The stopper 84 is actuated in the direction of the center line A1 together with the push lever 80. An elastic member 81 biases the push lever 80 in the direction away from the housing 11 in the direction of the center line A1. The elastic member 81 is, for example, a metal compression spring. The push lever 80 biased by the elastic member 81 comes into contact with the stopper 84 to be stopped at the initial position. A trigger switch 83 is provided in the handle 20. The trigger switch 83 is turned on when an operation force is applied to the trigger 54, and is turned off when the operation force on the trigger 54 is released.

A solenoid 85 is provided in the magazine 60. The solenoid 85 is a keep solenoid having a coil 86, a plunger 87, and a permanent magnet 88. The plunger 87 is made of a magnetic material, for example, iron, and the plunger 87 can be actuated in the direction of a center line A4. The center line A2 shown in FIG. 3 and the center line A4 shown in FIG. 7 are arranged in parallel. As shown in FIG. 7, the center line A1 and the center line A4 are arranged so as to intersect each other in a plane parallel to the center line A1, and are arranged so as to intersect at an angle of 90 degrees, for example. Although not shown, the center line A1 and the center line A4 are arranged so as to be separated from each other in a plane perpendicular to the center line A2 in FIG. 3.

Figure 9:
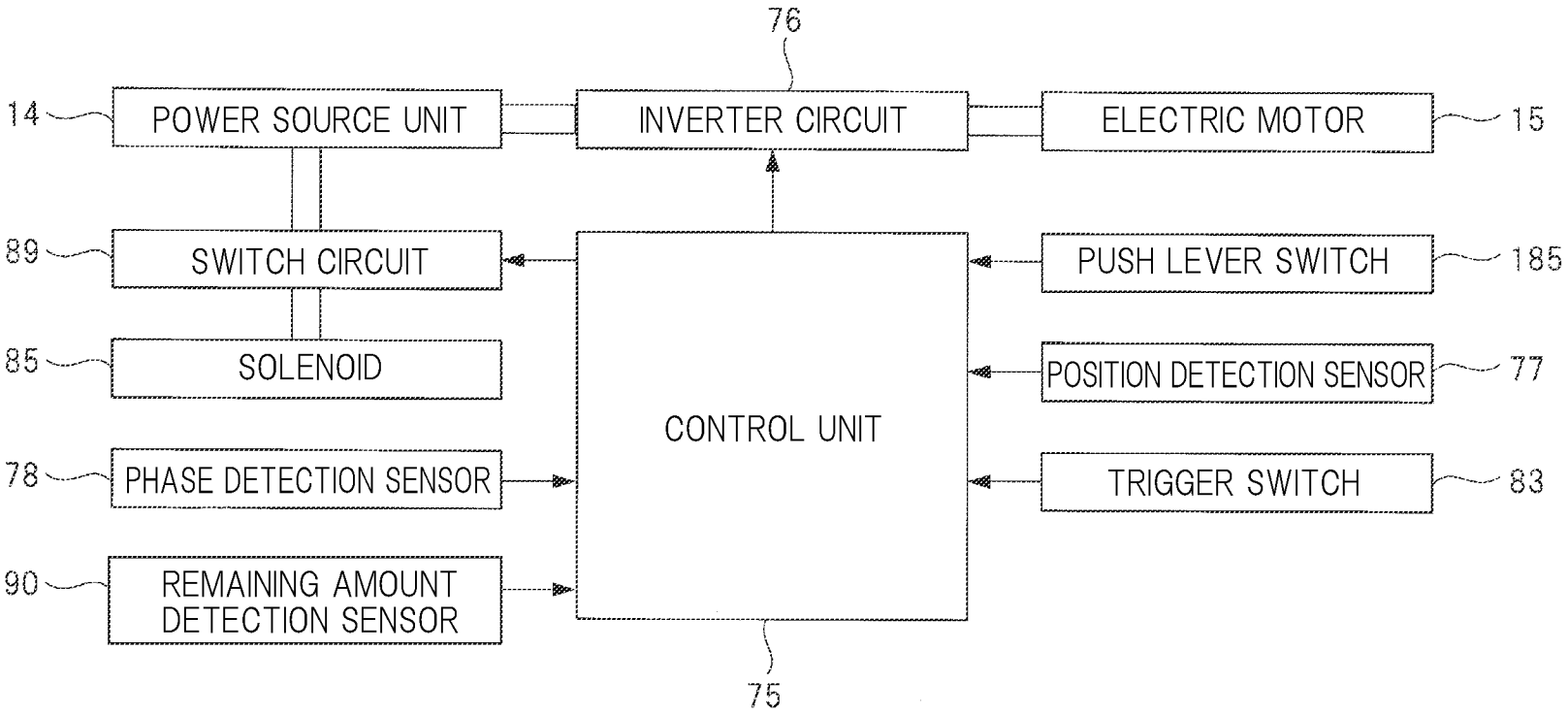
FIG. 9 is a block diagram showing a control system in the driving tool according to the second embodiment.

A switch circuit 89 shown in FIG. 9 is provided between the solenoid 85 and the power source unit 14. The switch circuit 89 can be turned on and off. The switch circuit 89 is operated so as to supply the current to the solenoid 85 or stop the current supply to the solenoid 85. When the current supply to the solenoid 85 is stopped, the plunger 87 is stopped by the attractive force of the permanent magnet 88. When a current is supplied to the solenoid 85, the plunger 87 is actuated in the direction of the center line A4 against the attractive force of the permanent magnet 88.

The switch circuit 89 can switch the direction of the current supplied from the power source unit 14 to the solenoid 85. When the direction of the current supplied to the solenoid 85 is switched, the direction in which the plunger 87 is actuated in the direction of the center line A4 is switched. The plunger 87 can be actuated in the direction away from the push lever 80 and the direction toward the push lever 80 in the direction of the center line A4 in FIG. 7.

Further, a push lever switch 185 shown in FIG. 9 is provided. The push lever switch 185 is provided in, for example, the ejection unit 32 or the housing 11. The push lever switch 185 is turned off when the push lever 80 is stopped at the initial position. The push lever switch 185 is turned on when the push lever 80 is pressed to the workpiece 79 and the push lever 80 reaches a position where the push lever 80 is actuated by a predetermined amount in the direction toward the housing 11 from the initial position.

Furthermore, a remaining amount detection sensor 90 is provided in the magazine 60. The remaining amount detection sensor 90 may be either a contact sensor or a non-contact sensor. The remaining amount detection sensor 90 detects the number of nails 61 held by the magazine 60 and outputs a signal. The remaining amount detection sensor 90 of this embodiment is turned off when the number of nails 61 is equal to or larger than a predetermined value, and is turned on when the number of nails 61 is smaller than the predetermined value. The predetermined value is an integer of "1" or more. The signal of the trigger switch 83, the signal of the push lever switch 185, and the signal of the remaining amount detection sensor 90 are input to the control unit 75. The control unit 75 controls the switch circuit 89 and the inverter circuit 76.

Figure 7:
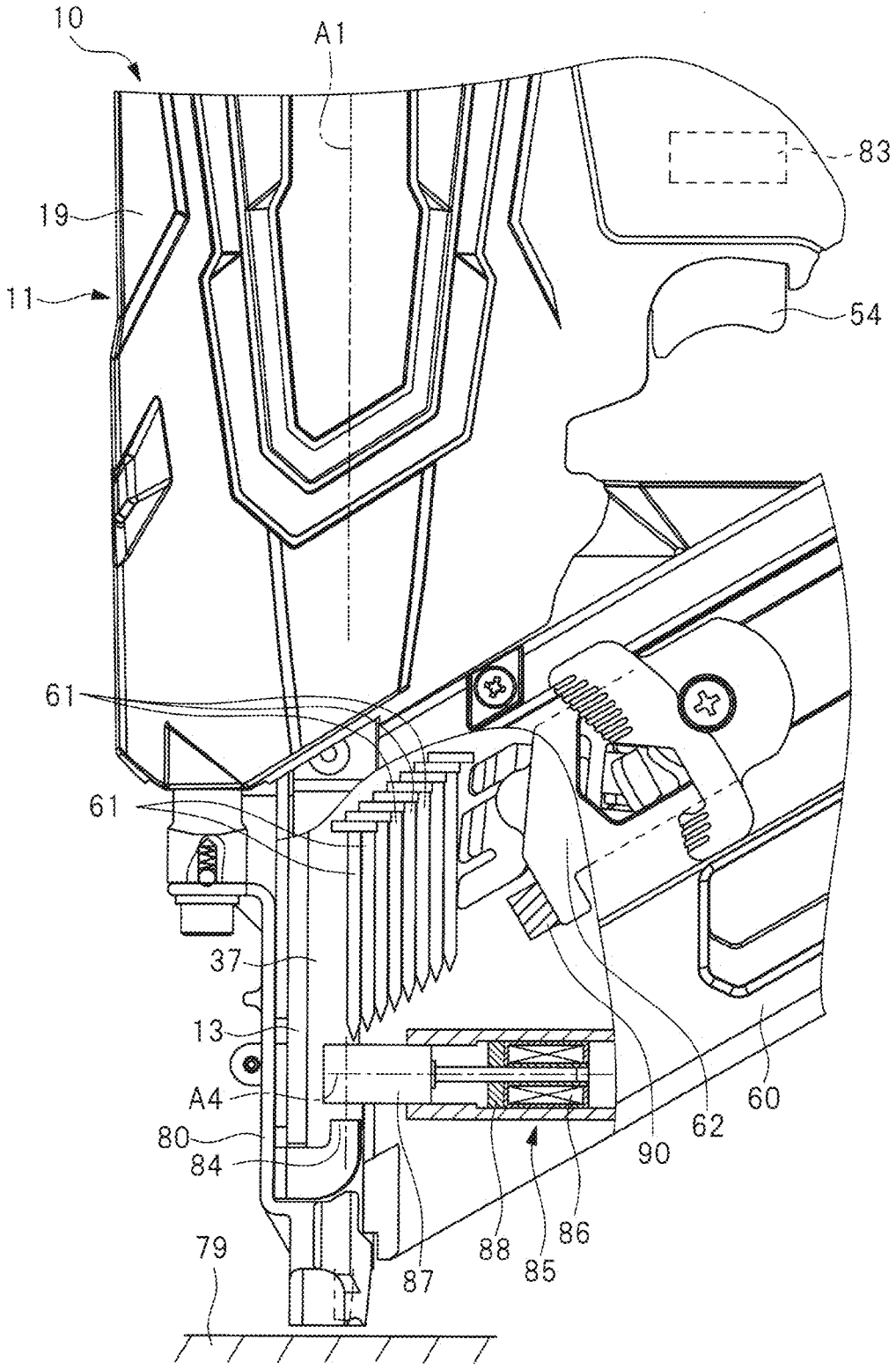
FIG. 7 is a front cross-sectional view showing a driving tool according to the second embodiment.
Figure 8:
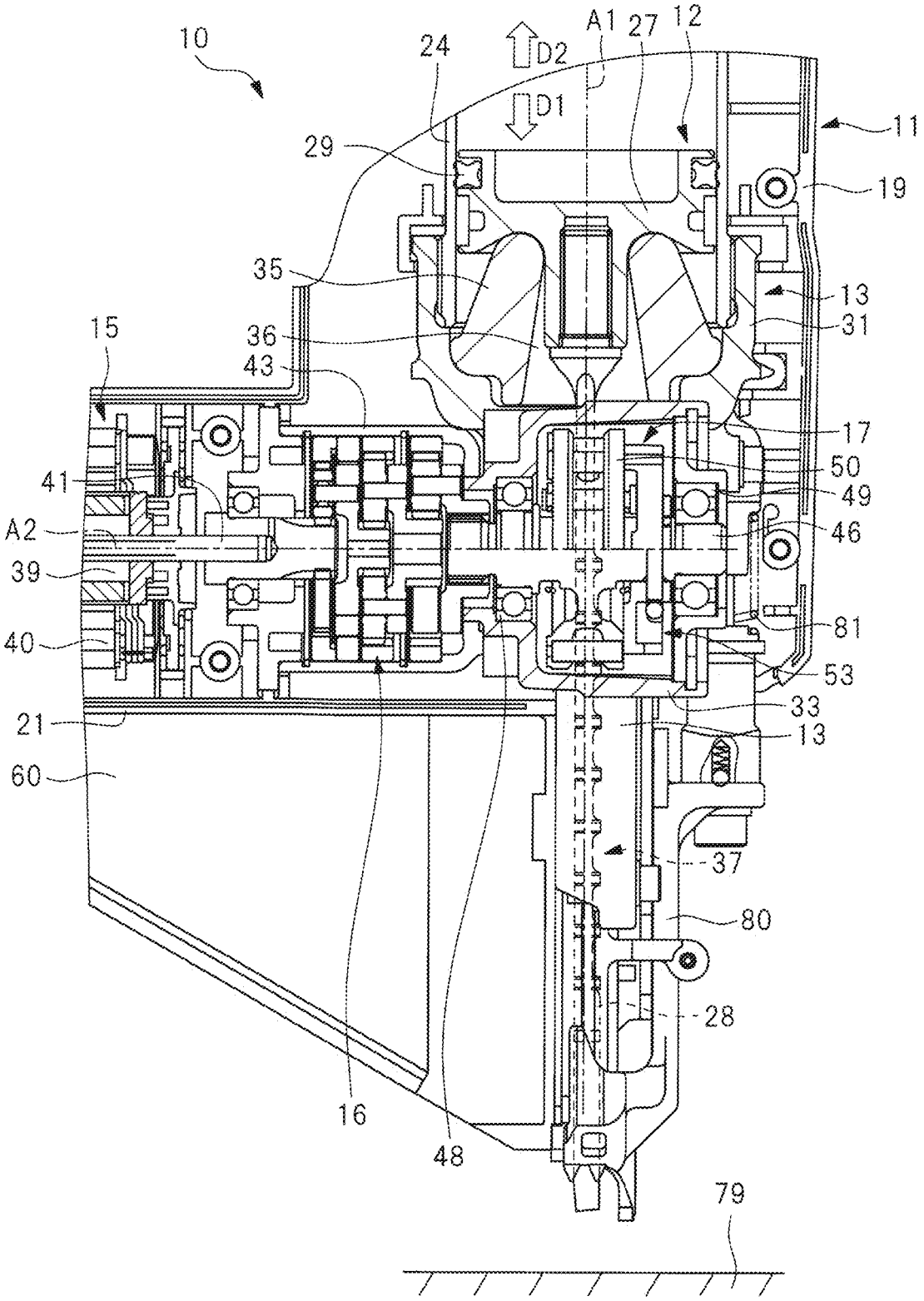
FIG. 8 is a rear cross-sectional view showing the driving tool according to the second embodiment.

In the driving tool 10 shown in FIG. 7 and FIG. 8, when the control unit 75 detects that the remaining amount detection sensor 90 is off, the control unit 75 stops the current supply to the solenoid 85 in the state where the plunger 87 is stopped at the initial position. The initial position of the plunger 87 is a position where the plunger 87 is separated from the push lever 80. When the plunger 87 is stopped at the initial position, all of the plunger 87 is located outside the actuation region of the stopper 84.

Therefore, when the worker presses the push lever 80 to the workpiece 79, the stopper 84 does not come into contact with the plunger 87. In the driving tool 10 shown in FIG. 7 and FIG. 8, when the control unit 75 shown in FIG. 9 detects that the push lever switch 185 is on and the trigger switch 83 is on, the electric motor 15 is actuated. Therefore, the striking unit 12 is actuated, so that the striking unit 12 strikes the nail 61.

Further, in the driving tool 10 shown in FIG. 7 and FIG. 8, when the control unit 75 shown in FIG. 9 detects that at least one of the push lever switch 185 and the trigger switch 83 is off, the control unit 75 stops the electric motor 15. Therefore, the striking unit 12 does not strike the nail 61.

On the other hand, when the control unit 75 detects that the remaining amount detection sensor 90 is on, the control unit 75 stops the current supply to the solenoid 85 in the state where the plunger 87 is stopped at the actuated position. The actuated position of the plunger 87 is a position where the plunger 87 comes close to the push lever 80. When the plunger 87 is stopped at the actuated position, a part of the plunger 87 is located in the actuation region of the stopper 84.

Therefore, even if the worker presses the push lever 80 to the workpiece 79, the actuation of the push lever 80 is blocked when the stopper 84 comes into contact with the plunger 87. Namely, the push lever switch 185 is held off. Therefore, when the number of nails 61 is less than the predetermined value, the control unit 75 stops the electric motor 15. Namely, the striking unit 12 is not actuated, and a blank firing can be prevented. The blank firing means that the striking unit 12 is actuated in the first direction D1 in the state where the nail 61 is not present in the ejection path 37.

As described above, the plunger 87 can be actuated in the direction of the center line A4, and when the plunger 87 is stopped at the actuated position, it is possible to prevent the blank firing. Unless the plunger 87 is actuated in the direction of the center line A4 and the plunger 87 is actuated from the actuated position to the initial position, the actuation of the push lever 80 is blocked and the push lever switch 185 is not turned on. Therefore, even if a part of the housing 11 or a tip of the push lever 80 comes into contact with an object different from the workpiece 79 and the housing 11 vibrates in the direction of the center line A1, it is possible to prevent the actuation of the plunger 87 in the direction of the center line A4. Accordingly, it is possible to reliably prevent the blank firing.

Third Embodiment

A driving tool according to the third embodiment will be described with reference to FIGS. 10, 11, 12, 13, and 14. A driving tool 100 includes a housing 111, a cylinder 112, a striking unit 113, a trigger 114, an ejection unit 115, and a push lever 116. Further, a magazine 117 is attached to the driving tool 100. The housing 111 has a tubular body portion 118, a head cover 121 fixed to the body portion 118, and a handle 119 connected to the body portion 118.

Figure 10:
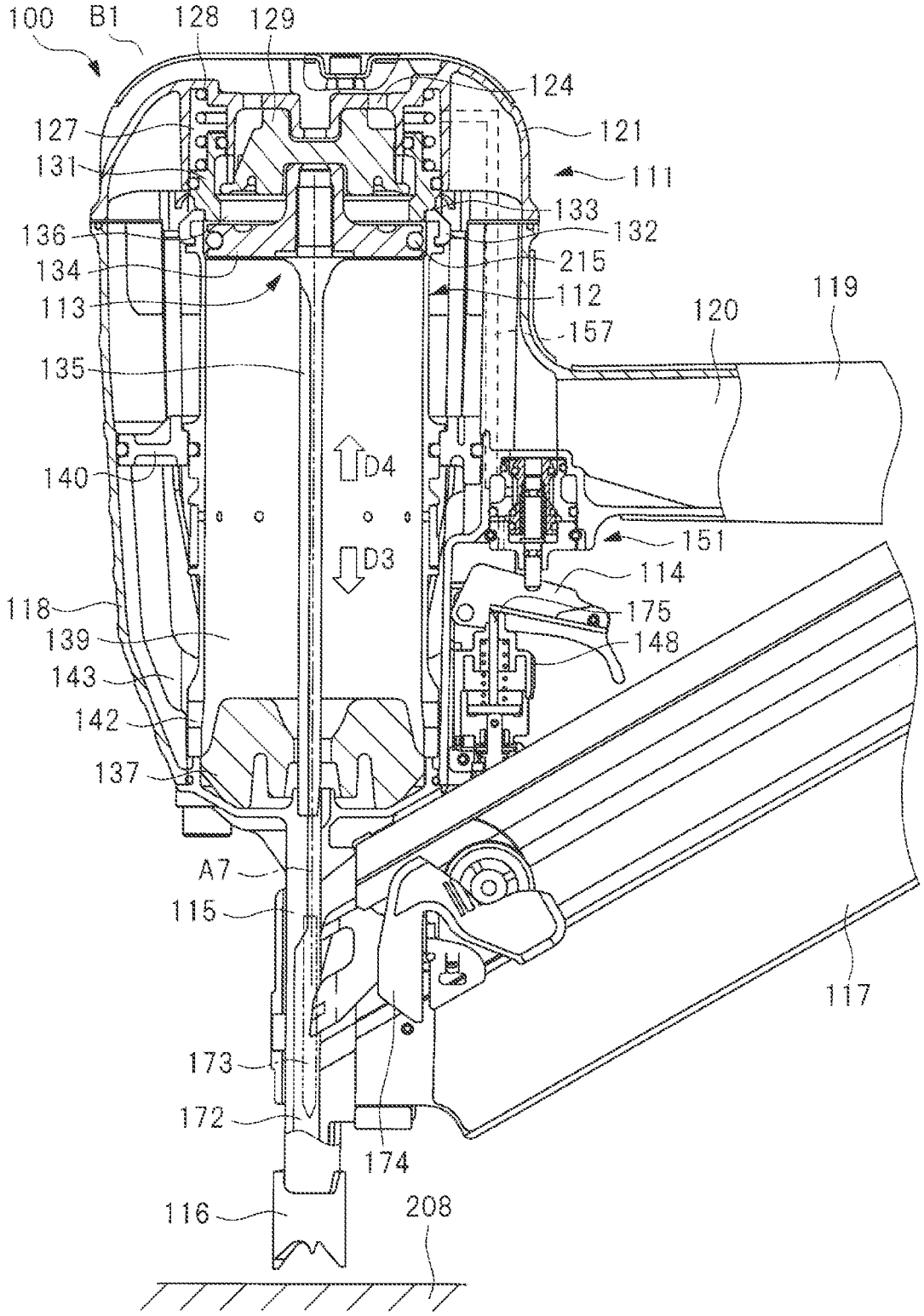
FIG. 10 is a front cross-sectional view showing a driving tool according to the third embodiment.

As shown in FIG. 10, a pressure accumulation chamber 120 is formed across the inside of the handle 119, the inside of the body portion 118, and the inside of the head cover 121. An air hose is connected to the handle 119. Compressed air as compressible gas is supplied into the pressure accumulation chamber 120 through the air hose. The cylinder 112 is provided in the body portion 118. The head cover 121 has an exhaust passage 124. The exhaust passage 124 connects the inside of the head cover 121 and the outside B1 of the housing 111.

A head valve 131 is provided in the head cover 121. The head valve 131 can be actuated in the direction of a center line A7 of the cylinder 112. A control chamber 127 is formed between the head valve 131 and the head cover 121. A biasing member 128 is provided in the control chamber 127. The biasing member 128 is, for example, a metal compression coil spring. The biasing member 128 biases the head valve 131 in the direction toward the cylinder 112 in the direction of the center line A7.

A stopper 129 is provided in the head cover 121. The stopper 129 is made of, for example, synthetic rubber. The cylinder 112 is positioned and fixed with respect to the body portion 118 in the direction of the center line A7. A valve seat 132 is attached to an end of the cylinder 112 at a position closest to the head valve 131 in the direction of the center line A7. The valve seat 132 has an annular shape and is made of synthetic rubber. A port 133 is formed between the head valve 131 and the valve seat 132. The head valve 131 constantly receives the pressure of the pressure accumulation chamber 120, and the head valve 131 is biased in the direction away from the valve seat 132 in the direction of the center line A7. The head valve 131 opens and closes the port 133.

The striking unit 113 includes a piston 134 and a driver blade 135 fixed to the piston 134. The piston 134 is arranged in the cylinder 112, and the striking unit 113 can be actuated in the direction of the center line A7. A sealing member 215 is attached to an outer peripheral surface of the piston 134. A piston upper chamber 136 is formed between the stopper 129 and the piston 134. When the head valve 131 opens the port 133, the piston upper chamber 136 and the pressure accumulation chamber 120 are connected. Also, the piston upper chamber 136 and the exhaust passage 124 are disconnected. When the head valve 131 closes the port 133, the piston upper chamber 136 and the pressure accumulation chamber 120 are disconnected. Also, the piston upper chamber 136 and the exhaust passage 124 are connected.

Figure 11:
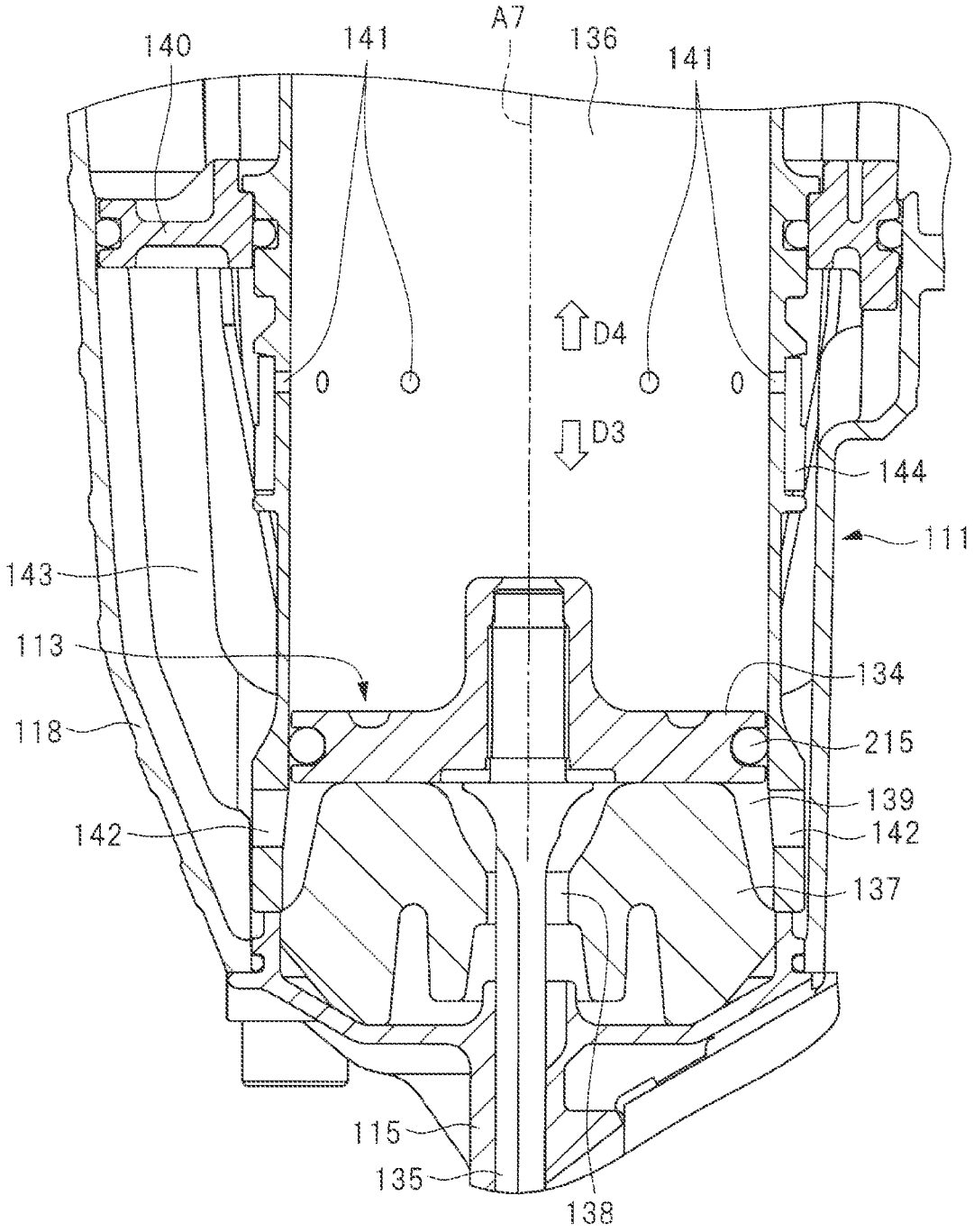
FIG. 11 is a front cross-sectional view showing an inside of a cylinder case of the driving tool in FIG. 10.

As shown in FIG. 11, a bumper 137 is provided in the cylinder 112. The bumper 137 is made of synthetic rubber or silicone rubber. The bumper 137 has a shaft hole 138, and the driver blade 135 can move in the shaft hole 138 in the direction of the center line A7. In the cylinder 112, a piston lower chamber 139 is formed between the piston 134 and the bumper 137. The sealing member 215 airtightly disconnects the lower piston chamber 139 and the upper piston chamber 136.

A holder 140 is provided in the body portion 118. The holder 140 has a tubular shape. The holder 140 is arranged concentrically with the cylinder 112 and outside the cylinder 112. Passages 141 and 142 that penetrate the cylinder 112 in the radial direction are provided. The passage 142 is arranged between the passage 141 and the ejection unit 115 in the direction of the center line A7. A return air chamber 143 is formed between the outer surface of the cylinder 112 and the body portion 118. The passage 141 connects the piston lower chamber 139 and the return air chamber 143.

A check valve 144 is provided in the cylinder 112. The check valve 144 opens the passage 141 when the air in the cylinder 112 tries to flow into the return air chamber 143. The check valve 144 closes the passage 141 when the air in the return air chamber 143 tries to flow into the cylinder 112. The passage 142 always connects the return air chamber 143 and the piston lower chamber 139. Compressed air is encapsulated across the inside of the piston lower chamber 139 and the return air chamber 143.

Figure 12:
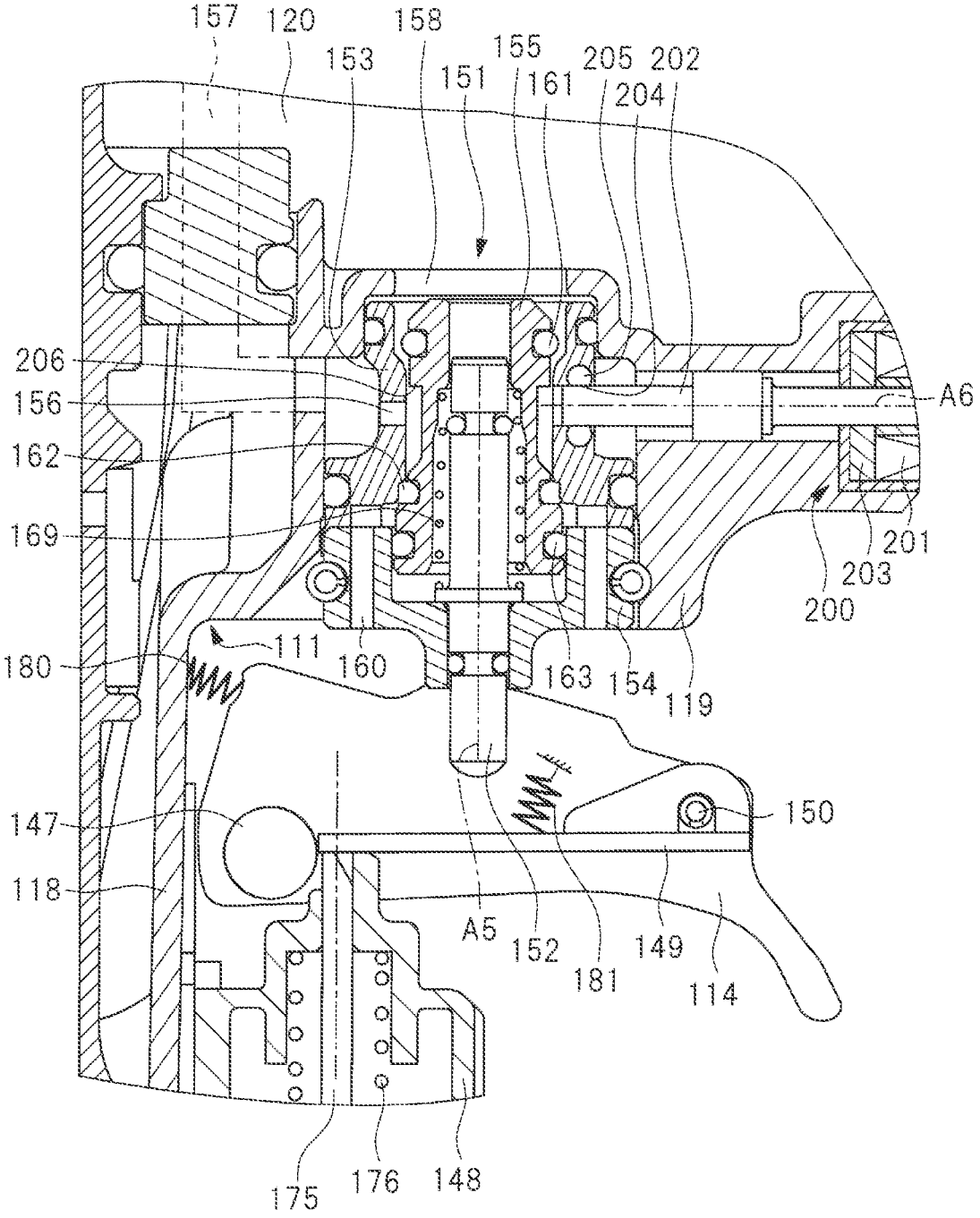
FIG. 12 is a front cross-sectional view of a trigger valve of the driving tool in FIG. 10.

As shown in FIG. 12, the trigger 114 is attached to the housing 111. The trigger 114 is attached to the housing 111 via a support shaft 147. The trigger 114 can be actuated about the support shaft 147 within a range of a predetermined angle. A biasing member 180 that biases the trigger 114 is provided. The biasing member 180 biases the trigger 114 clockwise about the support shaft 147. The biasing member 180 is, for example, a metal spring. A tubular holder 148 is attached to the housing 111. The trigger 114, which is biased by the biasing member 180, is stopped at the initial position in contact with the holder 148.

As shown in FIG. 12, the arm 149 is attached to the trigger 114. The arm 149 can be actuated about the support shaft 150 within a range of a predetermined angle with respect to the trigger 114. A biasing member 181 that biases the arm 149 is provided. The biasing member 181 biases the arm 149 counterclockwise in FIG. 12. The biasing member 181 is, for example, a metal spring. A free end of the arm 149 biased by the biasing member 181 comes into contact with a support portion 183 and is stopped at the initial position.

As shown in FIG. 12, a trigger valve 151 is provided in the housing 111. The trigger valve 151 includes a plunger 152, a first body 153, a second body 154, a valve body 155, and a biasing member 169. The plunger 152 can be actuated in the direction of a center line A5. The center line A5 and the center line A7 are arranged in parallel. The first body 153 has a tubular shape. A passage 156 is formed so as to penetrate the first body 153 in the radial direction, and the passage 156 is connected to the control chamber 127 via a passage 157.

Further, the handle 119 has a passage 158, and the passage 158 connects the pressure accumulation chamber 120 and the inside of the first body 153. The second body 154 has a passage 160. The valve body 155 is arranged inside the first body 153, and the valve body 155 can be actuated in the direction of the center line A5 with respect to the first body 153. Sealing members 161, 162, and 163 are attached to the outer peripheral surface of the valve body 155.

The ejection unit 115 shown in FIG. 10 is made of, for example, metal or non-ferrous metal. The ejection unit 115 has an ejection path 172. The center line A7 is located in the ejection path 172, and the driver blade 135 can move in the direction of the center line A7 in the ejection path 172. The magazine 117 is fixed to the ejection unit 115. The magazine 117 stores nails 173. The magazine 117 includes a feeder 174, and the feeder 174 feeds the nails 173 in the magazine 117 to the ejection path 172.

The push lever 116 is attached so as to be actuatable with respect to the ejection unit 115 in the direction of the center line A7. Also, a transmission member 175 is supported by the holder 148 so as to be actuatable. The transmission member 175 is connected to the push lever 116 so as to be able to transmit power. The transmission member 175 can be actuated in parallel to the push lever 116. The transmission member 175 is biased by a biasing member 176 in the direction away from the arm 149. The biasing member 176 is, for example, a metal spring.

As shown in FIG. 12, a solenoid 200 is provided in the housing 111, for example, in the handle 119. The solenoid 200 is a keep solenoid having a coil 201, a plunger 202, and a permanent magnet 203. The plunger 202 is made of a magnetic material, for example, iron or steel. The plunger 202 can be actuated in the direction of a center line A6. Namely, the plunger 202 can come close to and separate from the valve body 155. The center line A6 and the center line A7 are arranged so as to intersect each other in a plane parallel to the center line A7, and are arranged so as to intersect at an angle of 90 degrees, for example. When a current flows through the coil 201 of the solenoid 200, the plunger 202 is actuated in the direction of the center line A6 against the attractive force of the permanent magnet 203. When the direction of the current flowing through the coil 201 is switched, the direction in which the plunger 202 is actuated is switched. When the supply of the current to the coil 201 is stopped, the plunger 202 is stopped by the attractive force of the permanent magnet 203.

Further, a support hole 204 which penetrates the first body 153 in the radial direction is provided. The support hole 204 connects the inside and the outside of the first body 153. A part of the plunger 202 is arranged in the support hole 204. A sealing member 205 is attached to the first body 153. The sealing member 205 has an annular shape and is made of synthetic rubber. The sealing member 205 is in contact with the outer peripheral surface of the plunger 202, and the sealing member 205 airtightly seals between the inner peripheral surface of the support hole 204 and the outer peripheral surface of the plunger 202. An annular engaging portion 206 is provided on the outer peripheral surface of the valve body 155. The engaging portion 206 is an end face perpendicular to the center line A5.

Figure 13:
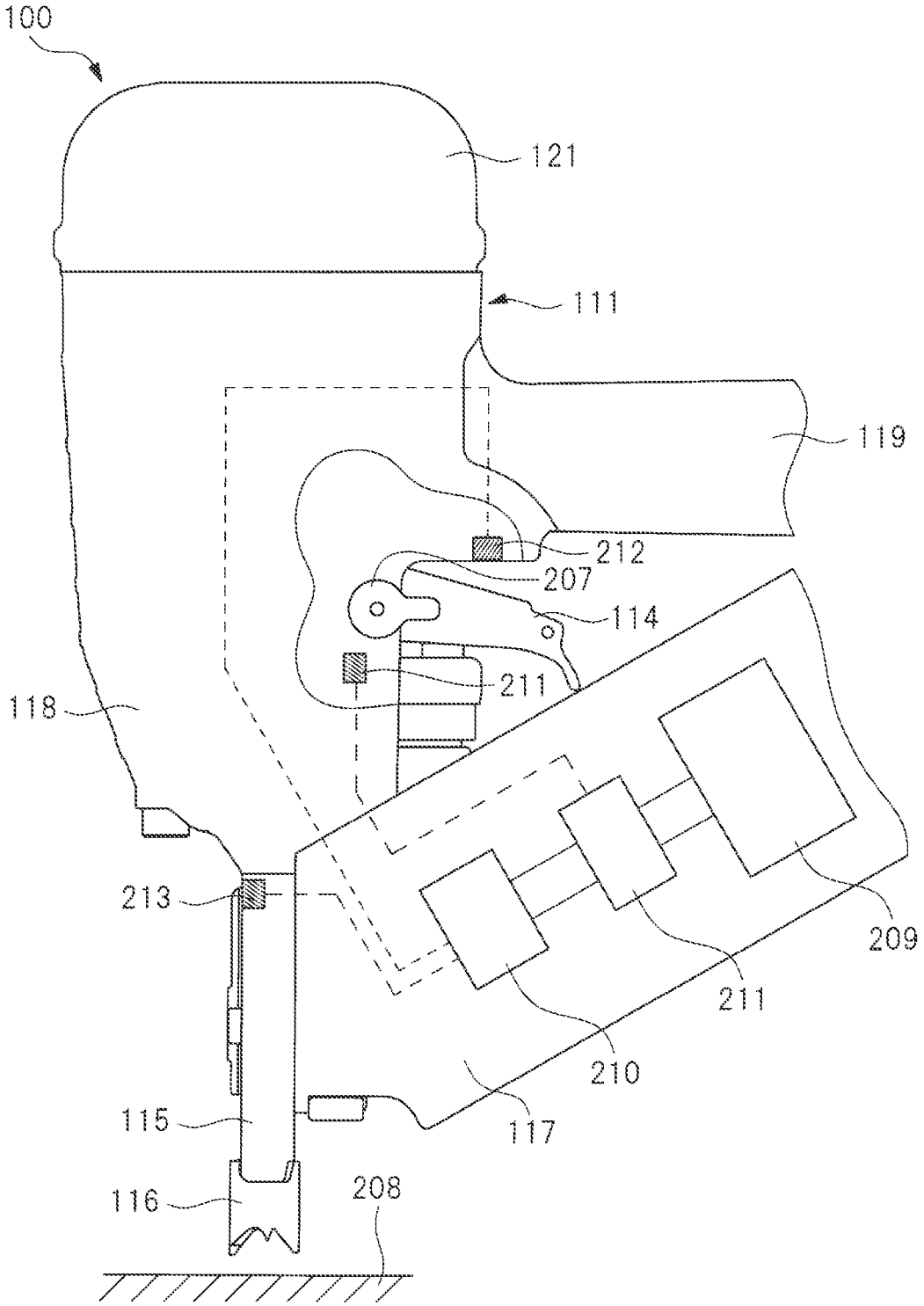
FIG. 13 is a schematic diagram showing the driving tool according to the third embodiment.
Figure 14:
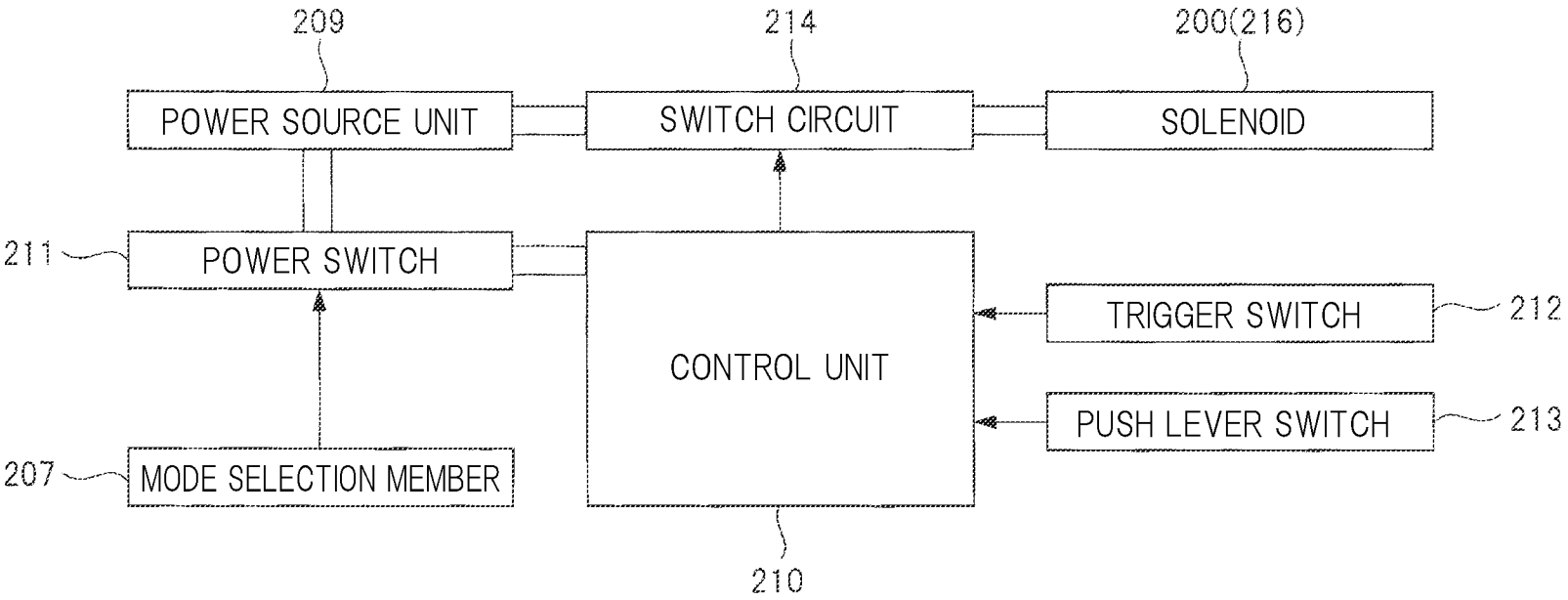
FIG. 14 is a block diagram showing a control system in the driving tool according to the third embodiment.

The driving tool 100 has a control system shown in FIG. 14. A mode selection member 207 is provided. As shown in FIG. 13, the mode selection member 207 is provided in, for example, the housing 111. The worker can switch between a first mode and a second mode by operating the mode selection member 207. When using the driving tool 100 in the procedure of applying an operation force to the trigger 114 in the state where the push lever 116 is being pressed to the workpiece 208, the worker selects the first mode in advance. When using the driving tool 100 in the procedure of pressing the push lever 116 to the workpiece 208 in the state where an operation force is being applied to the trigger 114, the worker selects the second mode in advance.

As shown in FIG. 13, a power source unit 209 and a control unit 210 are provided in the magazine 117. The power source unit 209 includes a battery cell. The control unit 210 is a microcomputer having an input/output interface, an arithmetic processing unit, and a storage unit. A power switch 211 that electrically connects and disconnects the control unit 210 and the power source unit 209 is provided. The power switch 211 is turned off when the first mode is selected and is turned on when the second mode is selected. When the power switch 211 is turned off, the current of the power source unit 209 is not supplied to the control unit 210, and the control unit 210 is stopped. When the power switch 211 is turned on, the current of the power source unit 209 is supplied to the control unit 210, and the control unit 210 is activated.

A trigger switch 212 and a push lever switch 213 are provided. The trigger switch 212 is provided in, for example, the housing 111. The trigger switch 212 is turned on when an operation force is applied to the trigger 114, and is turned off when the operation force on the trigger 114 is released. The push lever switch 213 is provided in, for example, the ejection unit 115. The push lever switch 213 is turned on when the push lever 116 is pressed to the workpiece 208 and is actuated, and is turned off when the push lever 116 is separated from the workpiece 208.

A switch circuit 214 that electrically connects and disconnects the power source unit 209 and the solenoid 200 is provided. In addition to supplying and stopping the current to the solenoid 200, the switch circuit 214 switches the direction of the current supplied to the solenoid 200. When the control unit 210 is activated, it processes the signal of the trigger switch 212 and the signal of the push lever switch 213. The control unit 210 controls the switch circuit 214.

Next, an example of using the driving tool 100 will be described. When the worker selects the first mode by operating the mode selection member 207, no current is supplied from the power source unit 209 to the control unit 210. Therefore, the control unit 210 is stopped. Further, when the first mode is selected, no current is supplied to the solenoid 200, and the plunger 202 is stopped at the initial position shown in FIG. 12. Namely, all of the plunger 202 is located outside the actuation range of the valve body 155.

Further, when at least one of the conditions that the operation force on the trigger 114 is released and that the push lever 116 is separated from the workpiece 208 is satisfied in the state where the first mode is selected, the trigger valve 151, the head valve 131, and the striking unit 113 of the driving tool 100 are in the following initial states.

As shown in FIG. 12, the plunger 152 is stopped at the initial position, and the sealing member 162 disconnects the passage 156 and the passage 160. The sealing member 161 is separated from the first body 153, and the pressure accumulation chamber 120 is connected to the control chamber 127 via the passage 158, the passage 156, and the passage 157.

Therefore, the compressed air in the pressure accumulation chamber 120 is supplied to the control chamber 127, and the head valve 131 is pressed to the valve seat 132 by the biasing force of the biasing member 128 and the pressure of the control chamber 127. Namely, the head valve 131 closes the port 133. Further, the piston upper chamber 136 is connected to the outside B1 via the exhaust passage 124. Accordingly, the pressure of the piston upper chamber 136 is equal to the atmospheric pressure and is lower than the pressure of the piston lower chamber 139. Therefore, the piston 134 is stopped in the state of being pressed to the stopper 129 by the pressure of the piston lower chamber 139. In this way, the striking unit 113 is stopped at the top dead center shown in FIG. 10.

Next, when the worker presses the push lever 116 to the workpiece 208 and applies an operation force to the trigger 114, the trigger 114 is actuated counterclockwise about the support shaft 147 in FIG. 12. Then, the actuation force of the arm 149 is transmitted to the plunger 152. The plunger 152 is actuated from the initial position against the biasing force of the biasing member 169, and the plunger 152 is stopped at the actuated position.

When the plunger 152 is stopped at the actuated position, the valve body 155 is actuated in the direction toward the arm 149 by the pressure of the pressure accumulation chamber 120 and is stopped. Then, the sealing member 161 disconnects the pressure accumulation chamber 120 and the passage 156. Further, the sealing member 162 is separated from the first body 153, and the passage 156 and the passage 160 are connected to each other. Therefore, the compressed air in the control chamber 127 is exhausted to the outside B1 through the passage 157, the passage 156, and the passage 160, and the pressure of the control chamber 127 becomes equal to the atmospheric pressure.

When the pressure of the control chamber 127 becomes equal to the atmospheric pressure, the head valve 131 is actuated by the pressure of the pressure accumulation chamber 120 against the biasing force of the biasing member 128, and the head valve 131 is separated from the valve seat 132. Namely, the head valve 131 opens the port 133, and the pressure accumulation chamber 120 is connected to the piston upper chamber 136. Further, the head valve 131 disconnects the piston upper chamber 136 and the exhaust passage 124.

Then, the compressed air in the pressure accumulation chamber 120 is supplied to the piston upper chamber 136, and the pressure of the piston upper chamber 136 increases. When the pressure of the piston upper chamber 136 becomes higher than the pressure of the piston lower chamber 139, the striking unit 113 is actuated in a first direction D3 from the top dead center to the bottom dead center, and the driver blade 135 strikes the nail 173 in the ejection path 172. The ejection path 172 guides the nail 173 such that the nail 173 moves in parallel to the center line A7 and does not intersect the center line A7. Then, the nail 173 whose moving direction is restricted is driven into the workpiece 208.

After the striking unit 113 drives the nail 173 into the workpiece 208, the piston 134 collides with the bumper 137 as shown in FIG. 11, and the bumper 137 absorbs a part of the kinetic energy of the striking unit 113. The position of the striking unit 113 at the time when the piston 134 collides with the bumper 137 is the bottom dead center. Also, while the striking unit 113 is being actuated in the first direction D3, the check valve 144 opens the passage 141, so that the compressed air in the piston lower chamber 139 flows into the return air chamber 143 from the passage 141.

When the worker releases the push lever 116 from the workpiece 208, the transmission member 175 returns to the initial position from the actuated position and is stopped by the biasing force of the biasing member 176. Also, when the worker releases the operation force on the trigger 114, the trigger 114 returns from the actuated position to the initial position, and the arm 149 returns to the initial position from the actuated position and is stopped by the biasing force of the biasing member 181.

Further, the plunger 152 returns to the initial position from the actuated position, and the valve body 155 returns to the initial position and is stopped. Therefore, the pressure accumulation chamber 120 is connected to the control chamber 127 via the passage 156 and the passage 157, and the passage 156 and the passage 160 are disconnected. Accordingly, the head valve 131 returns to the initial state and closes the port 133. Then, the pressure of the piston upper chamber 136 becomes equal to the atmospheric pressure, and the striking unit 113 is actuated in a second direction D4 by the pressure of the piston lower chamber 139. The second direction D4 is opposite to the first direction D3. Further, the compressed air in the return air chamber 143 flows into the piston lower chamber 139 through the passage 142, and the striking unit 113 returns to the top dead center and is stopped.

Next, an example in which the worker selects the second mode by operating the mode selection member 207 will be described. When the worker selects the second mode, the power switch 211 is turned on, a current is supplied from the power source unit 209 to the control unit 210, and the control unit 210 is activated. When the trigger switch 212 is turned on and the push lever switch 213 is turned off after the worker selects the second mode, the states of the trigger valve 151, the head valve 131, and the striking unit 113 of the driving tool 100 are the same as those when the first mode is selected.

Further, when the trigger switch 212 is turned on after the second mode is selected, the control unit 210 performs the following control. First, the control unit 210 detects the elapsed time from the time when the trigger switch 212 is turned on. When the elapsed time is within a predetermined time, the control unit 210 turns off the switch circuit 214 and stops the power supply to the solenoid 200. The predetermined time is, for example, 3 seconds. Therefore, the plunger 202 of the solenoid 200 is stopped at the initial position shown in FIG. 12. Namely, all of the plunger 202 is located outside the actuation range of the valve body 155.

When the control unit 210 detects that the elapsed time from when the trigger switch 212 is turned on is within the predetermined time and the push lever switch 213 is turned on, the control unit 210 stops the current supply to the solenoid 200 to hold the plunger 202 at the initial position. Further, the control unit 210 resets the detected elapsed time.

Then, the actuation force of the arm 149 is transmitted to the plunger 152, and the plunger 152 is stopped at the actuated position. Then, the valve body 155 is actuated in the direction toward the trigger 114 by the pressure of the pressure accumulation chamber 120, as in the case where the first mode is selected. Here, all of the plunger 202 is located outside the actuation range of the valve body 155. Therefore, the plunger 202 does not block the actuation of the valve body 155. Accordingly, the sealing member 161 disconnects the pressure accumulation chamber 120 and the passage 156, and the passage 156 and the passage 160 are connected to each other. Namely, the striking unit 113 is actuated from the top dead center to the bottom dead center.

On the other hand, when the elapsed time exceeds the predetermined time in the state where the trigger switch 212 is turned on and the push lever switch 213 is turned off, the control unit 210 supplies a current to the solenoid 200 and stops the supply of the current to the solenoid 200. Then, the plunger 202 comes close to the valve body 155 from the initial position shown in FIG. 15, and the plunger 202 is stopped at the actuated position. When the plunger 202 is stopped at the actuated position, a part of the plunger 202 is located in the first body 153. Namely, a part of the plunger 202 is located within the actuation range of the valve body 155.

Then, if the push lever 116 comes into contact with an object different from the workpiece 208 after the trigger switch 212 is turned on and the elapsed time exceeds the predetermined time, the following action occurs. The actuation force of the push lever 116 is transmitted to the plunger 152 through the transmission member 175 and the arm 149. Here, when the valve body 155 tries to be actuated in the direction toward the arm 149 by the pressure of the pressure accumulation chamber 120, the plunger 202 engages with the engaging portion 206, and the plunger 202 blocks the actuation of the valve body 155. Namely, the trigger valve 151 is held in a state of connecting the pressure accumulation chamber 120 and the passage 156 and disconnecting the passage 156 and the passage 160.

Therefore, even if the push lever 116 comes into contact with an object different from the workpiece 208 after the trigger switch 212 is turned on and the elapsed time exceeds the predetermined time, the striking unit 113 is stopped at the top dead center, and the striking unit 113 does not strike the nail 173. Note that, when the control unit 210 detects that the trigger switch 212 is off after the trigger switch 212 is turned on and the elapsed time exceeds the predetermined time, the control unit 210 resets the detected elapsed time.

In the driving tool 100, the push lever 116 can be actuated in the direction of the center line A7. Further, the plunger 202 that blocks the actuation of the valve body 155 can be actuated in the direction of the center line A6. Although not shown, the center line A7 and the center line A6 are arranged so as to intersect each other in a plane parallel to the center line A7, and are arranged so as to intersect at an angle of 90 degrees, for example.

Therefore, even if a part of the housing 111 or the tip of the push lever 116 comes into contact with an object and the housing 111 vibrates in the direction of the center line A7, it is possible to prevent the actuation of the plunger 202 in the direction of the center line A6. Therefore, it is possible to suppress the actuation of the plunger 202 from the actuated position to the initial position, and prevent the actuation of the striking unit 113.

Further, the control unit 210 stops the supply of the current from the power source unit 209 to the solenoid 200 while the plunger 202 of the solenoid 200 is being stopped in the initial state or the actuated state. Therefore, it is possible to suppress an increase in the power consumption of the power source unit 209.

Fourth Embodiment

Figure 15:
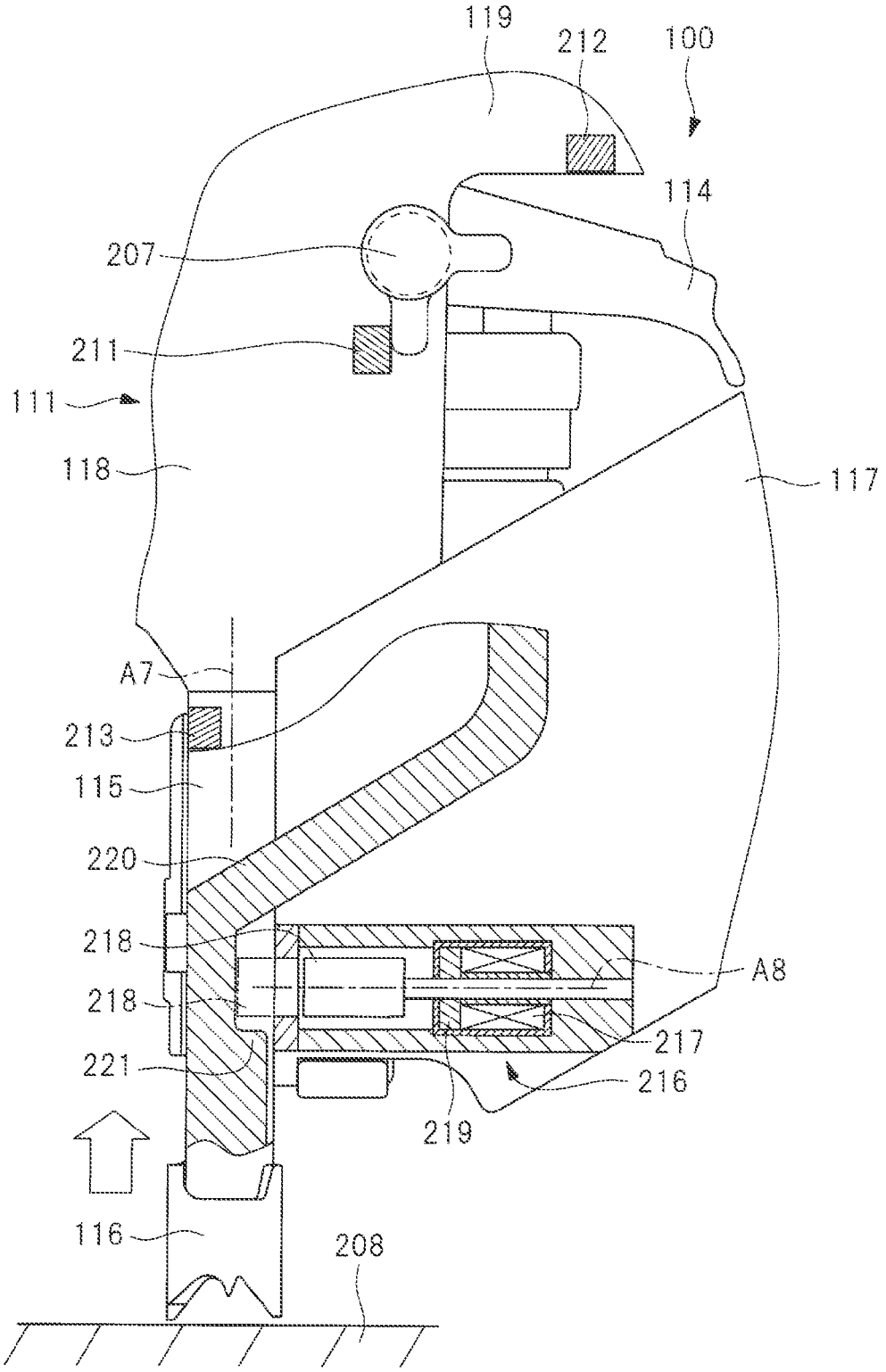
FIG. 15 is a partial front cross-sectional view showing a driving tool according to the fourth embodiment.

A driving tool according to the fourth embodiment will be described with reference to FIG. 15. The configuration of the driving tool 100 shown in FIG. 15 is the same as that of the driving tool 100 shown in FIGS. 10, 11, 12, and 13. The driving tool 100 shown in FIG. 15 does not have the solenoid 200 shown in FIG. 12. The driving tool 100 shown in FIG. 15 has a solenoid 216. The solenoid 216 is provided in the magazine 117.

The solenoid 216 is a keep solenoid having a coil 217, a plunger 218, and a permanent magnet 219. The plunger 218 can be actuated in the direction of a center line A8. The center line A7 and the center line A8 are arranged so as to intersect each other, and are arranged so as to intersect at an angle of 90 degrees, for example. The plunger 218 is made of a magnetic material, for example, iron or steel.

The driving tool 100 shown in FIG. 15 has a control system shown in FIG. 14. The switch circuit 214 is provided between the power source unit 209 and the solenoid 216. The control unit 210 controls the switch circuit 214 to control the supply and stop of the current to the solenoid 216 and the direction of the current.

When a current flows through the coil 217 of the solenoid 216, the plunger 218 is actuated in the direction of the center line A8 against the attractive force of the permanent magnet 219. By switching the direction of the current supplied to the solenoid 216 by the control unit 210, the direction in which the plunger 218 is actuated can be changed.

When the control unit 210 stops the supply of the current to the solenoid 216, the plunger 218 is stopped by the attractive force of the permanent magnet 219.

An arm 220 that transmits the actuation force of the push lever 116 to the transmission member 175 is provided. The arm 220 has an engaging portion 221. The arm 220 can be actuated in the direction of the center line A7 together with the push lever 116.

Next, an example of using the driving tool 100 shown in FIG. 15 will be described. When the worker selects the first mode by operating the mode selection member 207, no current is supplied from the power source unit 209 to the control unit 210. Therefore, the control unit 210 is stopped. Further, when the first mode is selected, no current is supplied to the solenoid 216, and the plunger 218 is stopped at the initial position shown by the solid line in FIG. 15. Namely, all of the plunger 218 is located outside the actuation range of the engaging portion 221.

Further, when at least one of the conditions that the operation force on the trigger 114 is released and that the push lever 116 is separated from the workpiece 208 is satisfied in the state where the first mode is selected, the trigger valve 151, the head valve 131, and the striking unit 113 of the driving tool 100 are in the same initial states as those of the driving tool 100 according to the third embodiment. Therefore, the striking unit 113 in FIG. 10 is stopped at the top dead center.

Next, when the worker presses the push lever 116 to the workpiece 208 and applies an operation force to the trigger 114, the actuation force of the push lever 116 is transmitted through the arm 220 and the transmission member 175. Therefore, the trigger valve 151 is turned to the actuated state from the initial state, and the striking unit 113 is actuated in the first direction D3 in FIG. 10.

Next, an example in which the worker selects the second mode by operating the mode selection member 207 will be described. When the worker selects the second mode, the power switch 211 is turned on, a current is supplied from the power source unit 209 to the control unit 210, and the control unit 210 is activated. When the trigger switch 212 is turned on and the push lever switch 213 is turned off after the worker selects the second mode, the states of the trigger valve 151, the head valve 131, and the striking unit 113 of the driving tool 100 are the same as those when the first mode is selected.

Further, when the trigger switch 212 is turned on after the second mode is selected, the control unit 210 performs the following control. First, the control unit 210 detects the elapsed time from the time when the trigger switch 212 is turned on. When the elapsed time is within a predetermined time, the control unit 210 turns off the switch circuit 214 and stops the power supply to the solenoid 216. The predetermined time is, for example, 3 seconds. Therefore, the plunger 218 of the solenoid 216 is stopped at the initial position shown by the solid line in FIG. 15. Namely, all of the plunger 218 is located outside the actuation range of the engaging portion 221.

When the control unit 210 detects that the elapsed time from when the trigger switch 212 is turned on is within the predetermined time and the push lever 116 is pressed to the workpiece 208 and the push lever switch 213 is turned on, the control unit 210 stops the current supply to the solenoid 216 to hold the plunger 218 at the initial position. Further, the control unit 210 resets the detected elapsed time.

When the push lever 116 is pressed to the workpiece 208 and is actuated in the direction toward the housing 111, the plunger 218 does not block the actuation of the arm 220. Therefore, the trigger valve 151 is switched from the initial state to the actuated state, and the striking unit 113 shown in FIG. 10 is actuated in the first direction D3.

On the other hand, when the elapsed time exceeds the predetermined time in the state where the trigger switch 212 is turned on and the push lever switch 213 is turned off, the control unit 210 supplies a current to the solenoid 216 and stops the supply of the current to the solenoid 216. Then, the plunger 218 comes close to the arm 220, and the plunger 218 is stopped at the actuated position shown by the two-dot chain line in FIG. 15. When the plunger 218 is stopped at the actuated position, a part of the plunger 218 is located within the actuation range of the engaging portion 221.

Then, if the push lever 116 comes into contact with an object different from the workpiece 208 after the trigger switch 212 is turned on and the elapsed time exceeds the predetermined time, the following action occurs. The engaging portion 221 engages with the plunger 218, and the plunger 218 blocks the actuation of the push lever 116. Namely, the trigger valve 151 is held in the initial state.

Therefore, even if the push lever 116 comes into contact with an object different from the workpiece 208 after the trigger switch 212 is turned on and the elapsed time exceeds the predetermined time, the striking unit 113 is stopped at the top dead center, and the striking unit 113 does not strike the nail 173. Note that, when the control unit 210 detects that the trigger switch 212 is off after the trigger switch 212 is turned on and the elapsed time exceeds the predetermined time, the control unit 210 resets the detected elapsed time.

In the driving tool 100, the push lever 116 can be actuated in the direction of the center line A7. Further, the plunger 218 that blocks the actuation of the push lever 116 can be actuated in the direction of the center line A8. The center line A7 and the center line A8 are arranged so as to intersect at an angle of 90 degrees in a plane parallel to the center line A7.

Therefore, even if a part of the housing 111 or the tip of the push lever 116 comes into contact with an object and the housing 111 vibrates in the direction of the center line A7, it is possible to prevent the actuation of the plunger 218 in the direction of the center line A8. Therefore, it is possible to suppress the actuation of the plunger 218 from the actuated position to the initial position, and prevent the actuation of the striking unit 113.

Further, the control unit 210 stops the supply of the current from the power source unit 209 to the solenoid 216 while the plunger 218 of the solenoid 216 is being stopped in the initial state or the actuated state. Therefore, it is possible to suppress an increase in the power consumption of the power source unit 209.

An example of the relationship between the matters disclosed in the embodiments of the driving tool and the matters described in the claims is as follows. The driving tools 10 and 100 are examples of a driving tool. The striking units 12 and 113 are examples of a striking unit. The nails 61 and 173 are examples of a fastener. The first directions D1 and D3 are examples of a direction in which the striking unit strikes the fastener. The electric motor 15, the pin wheel 50, the clutch 17, and the pressure chamber 25 are examples of a driver unit. Further, the piston lower chamber 139, the piston upper chamber 136, and the head valve 131 are examples of a driver unit. The ejection units 32 and 115 are examples of an ejection unit.

The solenoids 70, 85, 200, and 216 are respectively examples of a switching mechanism. The state where the plunger 72 is stopped at the initial position is an example of a first state of the solenoid 70. The state where the plunger 87 is stopped at the initial position is an example of a first state of the solenoid 85. The state where the plunger 202 is stopped at the initial position is an example of a first state of the solenoid 200. The state where the plunger 218 is stopped at the initial position is an example of a first state of the solenoid 216.

The state where the plunger 72 is stopped at the actuated position is an example of a second state of the solenoid 70. The state where the plunger 87 is stopped at the actuated position is an example of a second state of the solenoid 85. The state where the plunger 202 is stopped at the actuated position is an example of a second state of the solenoid 200. The state where the plunger 218 is stopped at the actuated position is an example of a second state of the solenoid 216.

The state where the pinion 51 and the rack 52 of the clutch 17 are released is an example of a first drive state of the driver unit. The state where the pinion 51 and the rack 52 of the clutch 17 are engaged is an example of a second drive state of the driver unit.

The state where the head valve 131 opens the port 133 and connects the piston upper chamber 136 and the pressure accumulation chamber 120 is an example of the first drive state. The state where the head valve 131 closes the port 133 and disconnects the piston upper chamber 136 and the pressure accumulation chamber 120 is an example of the second drive state.

The direction of the center line A3 in which the plunger 72 of the solenoid 70 is actuated is an example of an actuation direction of the switching mechanism. The direction of the center line A4 in which the plunger 87 of the solenoid 85 is actuated is an example of an actuation direction of the switching mechanism. The direction of the center line A6 in which the plunger 202 of the solenoid 200 is actuated is an example of an actuation direction of the switching mechanism. The direction of the center line A8 in which the plunger 218 of the solenoid 216 is actuated is an example of an actuation direction of the switching mechanism. The center lines A1 and A7 are respectively examples of a moving direction of the fastener, a driving direction of the fastener, and an actuation direction of a contact member. The coils 71, 86, 201, and 217 are respectively examples of a coil. The plungers 72, 87, 202, and 218 are respectively examples of an actuation member.

The first directions D1 and D3 are examples of a first direction, and the second directions D2 and D4 are examples of a second direction. The pressure chamber 25 is an example of a first biasing mechanism, a pressure chamber, and a first pressure chamber. The electric motor 15, the pin wheel 50, and the clutch 17 are examples of a second biasing mechanism. The clutch 17 is an example of a clutch and an example of a path for transmitting a biasing force of the second biasing mechanism to the striking unit. The control unit 75 is an example of a control unit.

The housing 11 is an example of a housing. The trigger is an example of an operating member. The tip 61A of the nail 61 is an example of a tip of the fastener. The tip 63A of the push lever 63 is an example of a tip of the contact member. The control unit 75 and the remaining amount detection sensor 90 are examples of a detection unit. The piston upper chamber 136 is an example of a second pressure chamber. The trigger valve 151 is an example of a valve. The actuated state of the trigger valve 151 is an example of the first drive state. The initial state of the trigger valve 151 is an example of the second drive state.

The driving tool is not limited to the above-described embodiments, and various changes can be made within the range not departing from the gist thereof. For example, the solenoid may have an elastic member that biases the plunger in the direction of the center line. In this case, when the power supply to the solenoid is stopped, the plunger is actuated by the force of the elastic member and is stopped, and when the power is supplied to the solenoid, the plunger is stopped against the force of the elastic member. Further, the switching mechanism may be an actuator that actuates the actuation member in the linear direction, and an electric motor and a rack and pinion mechanism may be used as the switching mechanism instead of the solenoid.

An electromagnet can be used as the second biasing mechanism instead of the electric motor 15 and the pin wheel 50. Namely, the striking unit is actuated in the second direction by the attractive force formed by the electromagnet. Examples of the clutch include a cam mechanism and an electromagnetic clutch in addition to a rack and pinion mechanism. The operating member may be either rotatable with respect to the housing or linearly actuatable with respect to the housing. Further, the form of the operating member may be any of a lever, a button, and an arm. In the driving tool 10, the standby position of the striking unit 12 may be the bottom dead center.

The control units 75 and 210 can be respectively implemented by at least one element of a processor, a control circuit, a storage device, a module, a unit, and the like. Examples of the motor that actuates the striking unit in the second direction include a hydraulic motor and a pneumatic motor in addition to the electric motor. The electric motor may be either a brushed motor or a brushless motor. The power source unit of the electric motor may be either a DC power source or an AC power source. The power source unit may be either detachably attached to the housing or connected to the housing via a power cable. The power source unit may be a primary battery instead of the secondary battery.

REFERENCE SIGNS LIST

10, 100: driving tool
12, 113: striking unit
15: electric motor
17: clutch
25: pressure chamber

32, 115: ejection unit
50: pin wheel
61, 173: nail
70, 85, 200, 216: solenoid
72, 87, 202, 218: plunger
131: head valve
136: piston upper chamber
139: piston lower chamber
A1, A3, A6, A7, A8: center line
D1, D3: first direction
D2, D4: second direction

The invention claimed is:

1. A driving tool including a striking unit provided to be actuatable and a driver unit configured to actuate the striking unit in a direction in which the striking unit strikes a fastener, the driving tool comprising:

an ejection unit configured to guide a moving direction of the fastener struck by the striking unit; and a switching mechanism having a first state and a second state for controlling the striking unit, actuated by a power supply to switch between the first state and the second state, and configured to maintain the first state or the second state when the power supply is stopped, wherein the first state allows the striking unit to drive the fastener into a workpiece and the second state blocks the striking unit from driving the fastener into the workpiece, and wherein an actuation direction of the switching mechanism and the moving direction of the fastener guided by the ejection unit are arranged so as to intersect each other.

2. The driving tool according to claim 1, further comprising a contact member configured to come into contact with or be separated from a workpiece into which the fastener is driven, wherein the contact member can be actuated with respect to the ejection unit, and the actuation direction of the switching mechanism and an actuation direction of the contact member are arranged so as to intersect each other.

3. The driving tool according to claim 2, wherein an actuation direction of the striking unit and the actuation direction of the contact member are parallel to each other, and wherein the actuation direction of the switching mechanism and the actuation direction of the contact member intersect each other on a plane parallel to the actuation direction of the striking unit.

4. The driving tool according to claim 2, wherein the driver unit includes:

a first biasing mechanism configured to actuate the striking unit in a first direction of striking the fastener;

a second biasing mechanism configured to actuate the striking unit in a second direction opposite to the first direction;

a clutch configured to connect and disconnect a path for transmitting a biasing force of the second biasing mechanism to the striking unit; and a control unit configured to connect and disconnect the path by actuating the clutch, wherein the first biasing mechanism includes a pressure chamber configured to bias the striking unit in the first direction by a pressure of compressible gas, wherein when the contact member comes into contact with the workpiece and the clutch connects the path, the striking unit is actuated in the second direction by the biasing force of the second biasing mechanism, so that a pressure of the pressure chamber increases, and wherein when the clutch disconnects the path after the striking unit is actuated in the second direction, the striking unit is actuated in the first direction by the pressure of the pressure chamber.

5. The driving tool according to claim 1, wherein the switching mechanism includes:

a coil configured to form a magnetic field when a current flows therethrough; and an actuation member configured to be actuated by the magnetic field formed by the coil, and wherein the actuation of the switching mechanism is the actuation of the actuation member.

6. The driving tool according to claim 1, further comprising a detection unit configured to detect whether the number of fasteners to be supplied to the ejection unit is equal to or larger than a predetermined value or smaller than the predetermined value, wherein the first state allows the striking unit to drive the fastener into the workpiece when the number of fasteners is equal to or larger than the predetermined value, and wherein the second state blocks the striking unit from driving the fastener into the workpiece when the number of fasteners is smaller than the predetermined value.

7. The driving tool according to claim 1, wherein the driver unit includes:

a first pressure chamber configured to accumulate compressible gas;

a second pressure chamber capable of actuating the striking unit in a first direction of striking the fastener when the compressible gas is supplied from the first pressure chamber and exhausting the compressible gas supplied from the first pressure chamber after the striking unit is actuated in the first direction; and a valve configured to supply the compressible gas from the first pressure chamber to the second pressure chamber and exhaust the compressible gas from the second pressure chamber, wherein the first state allows the striking unit to drive the fastener into the workpiece by supplying the compressible gas from the first pressure chamber to the second pressure chamber by the valve, and wherein the second state blocks the striking unit from driving the fastener into the workpiece by exhausting the compressible gas from the second pressure chamber by the valve.

8. The driving tool according to claim 7, wherein the valve supplies the compressible gas from the first pressure chamber to the second pressure chamber when the contact member comes into contact with the workpiece and is actuated and exhausts the compressible gas from the second chamber when the contact member is separated from the workpiece, wherein the first state of the switching mechanism is a state which allows the contact member to come into contact with the workpiece and be actuated, and wherein the second state of the switching mechanism is a state which blocks the contact member from coming into contact with the workpiece and being actuated.

* * * * *